US006716562B2

(12) United States Patent
Uehara et al.

(10) Patent No.: US 6,716,562 B2
(45) Date of Patent: Apr. 6, 2004

(54) METHOD AND APPARATUS FOR FORMING AN IMAGE

(75) Inventors: Yasuhiro Uehara, Ashigarakami-gun (JP); Motofumi Baba, Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/098,455

(22) Filed: Mar. 18, 2002

(65) Prior Publication Data

US 2003/0068571 A1 Apr. 10, 2003

(30) Foreign Application Priority Data

Aug. 20, 2001 (JP) ..... 2001-248707

(51) Int. Cl.[7] ..... G03G 13/20; B41J 2/17

(52) U.S. Cl. ..... 430/124; 430/126; 399/246; 399/308; 347/103; 347/105

(58) Field of Search ..... 430/124, 126; 399/308, 246; 347/103, 105

(56) References Cited

U.S. PATENT DOCUMENTS 5,928,823 A * 7/1999 Kato ..... 430/126
6,200,647 B1 * 3/2001 Emslander et al. ..... 430/126

* cited by examiner

*Primary Examiner*—Mark A. Chapman
(74) *Attorney, Agent, or Firm*—Oliff & Berridge PLC

(57) ABSTRACT

Methods and apparatus for forming on a recording medium an image whose resistance to water and light is improved and whose image quality is enhanced, with printing speed being increased due to drying of ink being accelerated. The methods include the steps of: forming a layer including resin particles on a surface of an intermediate transfer medium or on a surface of a recording medium; recording the image by jetting ink from an inkjet recording head onto the resin particle layer so that the ink is retained in cavities of the resin particle layer; and either transferring the resin particle layer from the surface of the intermediate transfer medium to a recording medium to fix the resin particle layer thereto or fixing the recording medium having the resin particle layer retaining the ink.

38 Claims, 9 Drawing Sheets

METHOD AND APPARATUS FOR FORMING AN IMAGE

BACKGROUND OF THE INVENTION

1. Field of the Invention

The present invention relates to methods and apparatus for forming an image using inkjet recording. More particularly, the present invention relates to methods and apparatus for forming an image using intermediate transfer inkjet recording, in which an ink image is formed on a surface of an intermediate transfer medium and then transferred to a recording medium to form an ink image on the surface of the recording medium, and to a method and apparatus for forming an image by inkjet recording, in which an ink image is directly formed on a recording medium.

2. Description of the Related Art

Various measures have conventionally been taken to accelerate drying of ink and to maintain high concentration with respect to methods for recording an image on plain paper by inkjet recording.

One such measure for accelerating drying of ink is to use easily dryable components for the ink in order to accelerate drying of the ink itself. However, since ink itself dries easily, ink within an inkjet recording head (hereinafter, sometimes referred to simply as "recording head") also dries, whereby the ink is either jetted unevenly or cannot be jetted at all due to the ink thickening and adhering to the interior of the recording head. This leads to a remarkable reduction in image quality and dependability. In addition, when a color image is recorded on plain paper, the amount of ink jetted per unit area is twofold or more of that of a monochrome image. There are thus problems in that it becomes easy for images to bleed, fixation to be deficient, and the paper to cockle due to head abrasion.

Another measure for accelerating drying of ink is to dispose means for drying the ink (e.g., a heater) in the image forming apparatus itself, as disclosed in Japanese Patent Application Laid-open (JP-A) No. 62-130863. However, when a recording medium is warmed to accelerate drying of the ink, substances that evaporate from the ink moisten the jetting surface of the recording head, whereby the ink is either jetted unevenly or cannot be jetted at all, which leads to a remarkable reduction in image quality and dependability. In addition, when a color image is recorded on plain paper, the amount of ink jetted per unit area is twofold or more of that of a monochrome image, there are thus problems in that it becomes easy for images to bleed and fixation to be poor. This tendency becomes more pronounced when the speed at which inkjet recording is conducted is increased.

A third measure for accelerating drying of ink is to employ multipass printing and repeatedly conduct printing several times, namely, to combine multi passes and staggered printing to thereby restrict the amount of ink jetted at one time and reduce fixing time. However, this leads to a reduction in recording speed and cannot be applied when the amount of ink jetted is increased for color images.

One measure to maintain high concentration is to change the ink components and dye concentration within the ink to thereby leave as much dye as possible on the paper. However, since ink itself dries easily, ink within the recording head also dries, whereby the ink may be either jetted unevenly or not at all due to the ink thickening and adhering to the interior of the recording head. This can lead to a remarkable reduction in image quality and dependability.

Another measure to maintain high concentration is to repeatedly conduct printing several times by combining multipass and staggered printing, whereby dye concentration per unit area is increased. However, this can in turn adversely affect fixation and lower recording speed.

When images are thus recorded by inkjet recording, there are drawbacks in that ordinary dyes are not resistant to water and characters bleed when they come into contact with saliva or wet hands. Although pigment inks and water-resistant dyes have been used to try to overcome these problems, there are problems in that it becomes necessary to use pigment inks and water-resistant dyes that have been made insoluble to aqueous solutions, and the recording head becomes clogged.

Although the adoption of pigment ink has been investigated as a measure to impart water-resistance to ink, there are problems in that expensive recovering means become necessary to avoid reduction in dependability, hues are lowered in color recording, and light transmittance is poor when recording on OHP paper. Moreover, adopting water-resistant ink leads to problems in that means similar to pigment inks are necessary to avoid reduction in dependability, and when water-resistance is imparted to a color dye, the light absorption spectrum of the dye itself increases and there is a drop in color reproducibility when color recording is conducted.

JP-A No. 64-63185 discloses using an inkjet recording head to adhere onto a recording paper a colorless ink that renders a dye insoluble. Additionally, JP-A No. 5-202328 discloses using both an ink that includes a chemical dye having a carboxyl group and a polyvalent metal salt solution for rendering a dye insoluble and printing the ink after the polyvalent metal salt solution is printed, to thereby obtain a water-resistant image with no color bleeding. However, there are problems in that, on the one hand, when the colorless ink that renders the dye insoluble or solutions such as the polyvalent metal salt solution come into contact with the ink in the image forming apparatus, the apparatus may break down and, on the other hand, the amount of ink jetted per unit area is about twofold in the case of a monochrome image and at least about 1.5-fold in the case of a color image, and it becomes easy for the recording medium to cockle and for fixation to be deficient.

In order to overcome these problems in the conventional art, a method and apparatus for forming an image have been proposed where hydrophilic resin particles are applied to a recording medium to retain ink, ink is jetting onto the hydrophilic resin particles with an inkjet recording head, and then the hydrophilic resin particles are fixed on a recording material to form the image (e.g., JP-A No. 5-96720). However, there are problems with the hydrophilic resin particles in that the reaction of the ink with a dye and weather-resistance is insufficient. There are also problems such as irregularity, deterioration of image quality, migration and the like due to swelling of the hydrophilic resin particles.

In conventional inkjet recording, phenomena such as floating ink generated by ink mist re-adhering to the recording head and ink droplets jetted onto the recording medium rebounding have also been observed. There is thus the potential for the recording head disposed downstream from the printing section to experience problems due to the ink droplets adhering to the recording head. Moreover, in order to obtain high image quality, it is necessary to enhance the precision of the position to which the ink droplets are jetted by decreasing the distance between the recording head and the recording medium and increasing the speed at which the ink is jetted, whereby the aforementioned problems experienced by the recording head become more pronounced.

SUMMARY OF THE INVENTION

An object of the present invention is to solve the various problems in inkjet recording described above. More particularly, an object of the present invention is to provide a method and an apparatus for forming on a recording medium, such as plain paper, an image whose resistance to water and light is improved and whose image quality is enhanced, with printing speed being increased due to drying of ink being accelerated. This object is achieved by the present inventions.

According to a first aspect of the invention, the present invention relates to a method for forming an image comprising at least the steps of: forming a layer including resin particles on a surface of an intermediate transfer medium; recording the image by jetting ink from an inkjet recording head onto the resin particle layer so that the ink is retained in cavities of the resin particle layer; and transferring the resin particle layer retaining the ink to a recording medium to fix the resin particle layer thereto.

According to the first aspect of the invention, the present invention also relates to an apparatus for forming an image comprising at least: an intermediate transfer medium; means for forming a layer including resin particles on a surface of the intermediate transfer medium: means for recording the image by jetting ink from an inkjet recording head onto the resin particle layer so that the ink is retained in cavities of the resin particle layer; and means for transferring the resin particle layer to a recording medium to fix the resin particle layer thereto.

The action and effects of the invention are as follows.

First, the resin particle layer including the resin particles is formed on the surface of the intermediate transfer medium by the particle layer forming means (the step of forming the resin particle layer). Numerous cavities are formed between the resin particles in the resin particle layer formed on the surface of the intermediate transfer medium.

Next, ink is jetted by the inkjet recording means from an inkjet recording head onto the resin particle layer formed on the surface of the intermediate transfer medium, with the cavities in the resin particle layer retaining the ink, to record an image (the step of recording). Because the ink is effectively retained in the cavities between the resin particles, drying of the ink is accelerated and problems such as bleeding and stains do not occur even when color images are printed. Moreover, jetted ink droplets do not rebound, whereby problems do not occur at the inkjet recording head. Therefore, various measures for improving image quality become possible.

Then, the resin particle layer retaining the ink is transferred to and fixed on the recording medium by suitable transferring and fixing means to form an image (the step of transferring and fixing). Because the resin particle layer retaining the ink is transferred to the recording medium, an image can be formed on any kind of recording medium without being affected by water absorption and drying properties of the surface of the recording medium. Further, when the resin particles are melted and hardened by fixing to form the resin particle layer, an image made of ink is incorporated into the resin layer, whereby an image having not only excellent resistance to water and light, which are insufficient in images formed solely with dye ink, but excellent ozone resistance as well (these may be generically referred to as "weather resistance" in some cases) can be formed.

According to a second aspect of the invention, the invention relates to a method for forming an image comprising at least the steps of: forming a layer including resin particles on a surface of a surface of a recording medium; recording an image by jetting ink from an inkjet recording head onto the resin particle layer so that the ink is retained in cavities of the resin particle layer; and fixing the resin particle layer retaining the ink.

According to the second aspect of the invention, the invention also relates to an apparatus for forming an image comprising at least: means for forming a layer including resin particles on a surface of a recording medium; means for recording the image by jetting ink from an inkjet recording head onto the resin particle layer so that the ink is retained in cavities of the resin particle layer; and means for fixing the resin particle layer retaining the ink.

The effects of the invention are as follows.

First, the resin particle layer including the resin particles is formed on the surface of the recording medium by suitable particle layer forming means (step of forming the resin particle layer). Numerous cavities are formed between the resin particles in the resin particle layer formed on the surface of the recording medium.

Next, ink is jetted by the inkjet recording means from an inkjet recording head onto the resin particle layer formed on the surface of the intermediate transfer medium, with the cavities in the resin particle layer retaining the ink, to record an image (the step of recording). Because the ink is effectively retained in the cavities between the resin particles, drying of the ink is accelerated and problems such as bleeding and stains do not occur even when color images are printed. Moreover, jetted ink droplets do not rebound, whereby problems do not occur at the inkjet recording head. Therefore, various measures for improving image quality become possible. Moreover, because an ink image is formed on the resin particle layer formed on the surface of the recording medium an image can be formed on any kind of recording medium without being affected by water absorption and drying properties of the surface of the recording medium.

Then, the resin particle layer retaining the ink is fixed on the recording medium by suitable fixing means to form an image (the step of fixing). When the resin particles are melted and hardened by fixing to form the resin particle layer, an image made of ink is incorporated into the resin layer, whereby an image having not only excellent resistance to water and light, which are insufficient in images formed solely with dye ink, but excellent ozone resistance as well can be formed.

DESCRIPTION OF THE PREFERRED EMBODIMENTS

Methods and apparatus for forming an image according to the present invention will be described below. The action and operation of the present invention will be described using first and present inventions together.

FIGS. 1A through 1D are schematic sectional views of an image part for illustrating the action and mechanism of the present invention.

Figure 1A:
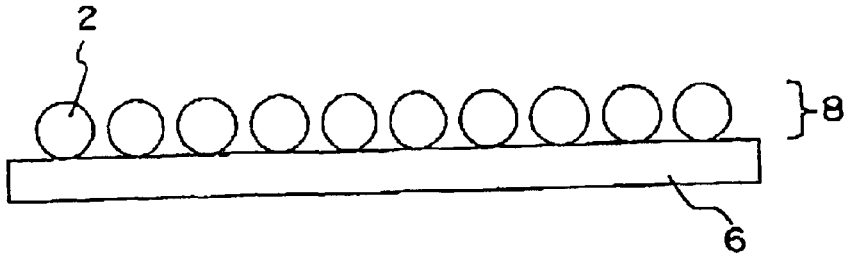
FIGS. 1A through 1D are schematic sectional views of an image part for illustrating the action and mechanism of the present invention.

As shown in FIG. 1A, a layer 8 including resin particles 2 is formed on a surface of a transfer medium 6 by a suitable layer forming means, with cavities being formed between the resin particles 2. The transfer medium 6 corresponds to an intermediate transfer medium in the first aspect of the invention and a recording medium in the second aspect of the invention.

Figure 1B:
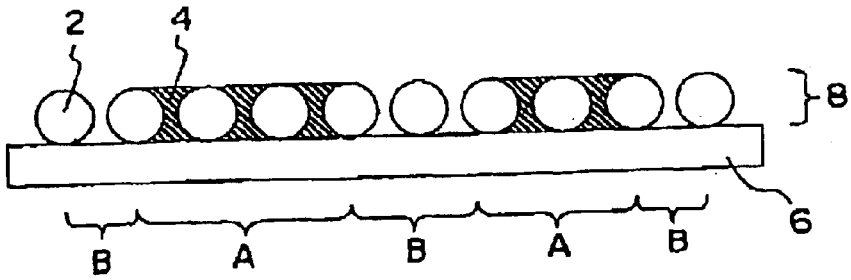
Figure 1C:
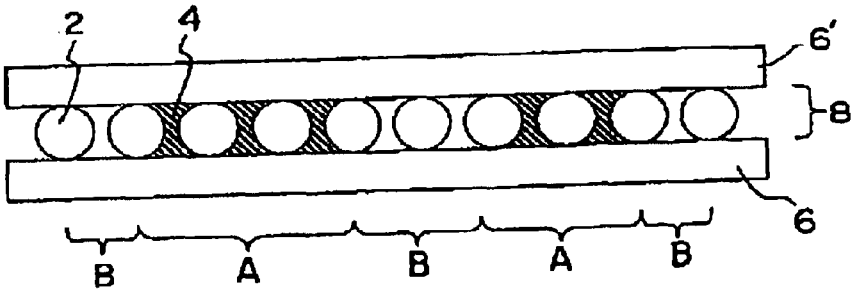
Figure 1D:
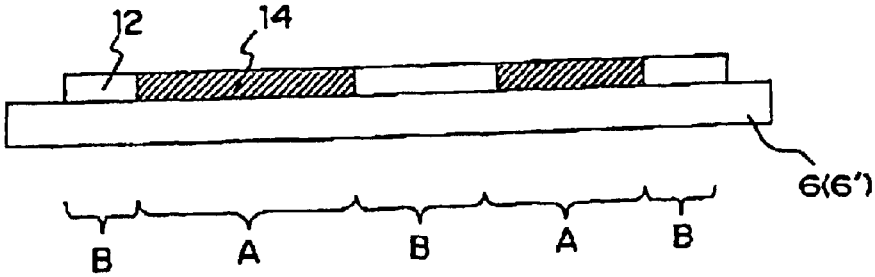

As shown in FIG. 1B, an image is recorded by jetting ink 4 image-wisely from an inkjet recording head onto the resin particle layer 8 by inkjet recording means, whereby the ink 4 is retained in the cavities of the resin particle layer 8. In FIGS. 1B, 1C and 1D, A represents image parts and B represents non-image parts.

Drying of the ink 4 is accelerated due to the ink 4 being effectively retained in the cavities between the resin particles 2, whereby problems such as bleeding and stains do not occur even if a color image is printed. Additionally, there is no danger of problems occurring at the recording head since the jetted ink droplets do not rebound. For this reason, various measures to enhance image quality become possible.

When the transfer medium 6 comprises the intermediate transfer medium, the resin particle layer 8 retaining the ink 4 is transferred to a recording medium 6' by suitable transferring means, as shown in FIG. 1C. When the transfer medium 6 comprises the recording medium, this step is omitted. The resin particle layer 8 on the surface of the transfer medium 6 (or recording medium 6') is then fixed by suitable fixing means to form an image including image parts 14 and non-image parts 12, as shown in FIG. 1D. The transfer shown in FIG. 1C and the fixation shown in FIG. 1D may be conducted simultaneously In the present invention, because an ink image is recorded on the resin particle layer 8 formed on the surface of the transfer medium 6, an image can be formed on any recording medium regardless of the hydrophilicity or dryability at the surface of the transfer medium 6 or the recording medium 6'. Namely, in the present invention, the surface of the recording medium or intermediate transfer medium is controlled by forming the particle layer so that the suitability of the surface for inkjet recording is excellent, and inkjet recording is conducted on the surface.

When the resin particles are melted by fixation and harden to form the resin layer, the ink image is incorporated in the resin layer, whereby it is possible to form an image having not only excellent resistance to light and water (which was insufficient in images formed only by dye inks), but excellent ozone-resistance (these may on occasion be collectively called "weather resistance").

Image Forming Method of the Present Invention

The image forming method of the present invention with now be described per each essential step. Unless otherwise stated, the following method is applied to both of the present inventions.

Step of Forming the Particle Layer

In this step, a layer comprising resin particles is formed on a surface of an intermediate transfer medium or recording medium.

There are no particular limitations on the resin particles usable in the present invention, as long as ink can be retained in cavities between the resin particles in the layer formed. However, when the resin particles are triboelectrically charged and the layer is formed on the surface of the intermediate transfer medium by electric field transfer, the resin particles must be chargeable. It is therefore preferable for the resin particles to comprise an insulating material and be meltable by heat in order for the resin particles to be fixed on the recording medium.

It is also preferable for the resin particles to comprise a transparent substance in order to improve color mixture after the ink has been retained and the resin particles have been fixed and in order to obtain an image having excellent color reproducibility.

Further, if needed, it is also preferable for the resin particles to include (internally or externally) additives typically used as toner particles for electrophotography, such as charge controlling agents, cleaning agents, agents for improving release, fluidizing agents, filler agents, solid microparticles and the like.

There are no particular limitations on how the resin particles are charged. Generally, methods of charging toner in electrophotographic development that are widely known as ways of charging insulating particles can be applied. These methods can be roughly divided into two kinds of methods. In the first, friction is generated by rubbing insulating particles with another substance. In the second, insulating particles are mixed with particles called carriers, and the two-component mixture is stirred and mixed to charge the resin particles. In either method, it is preferable for the resin particles to comprise insulating particles, with volume resistivity thereof preferably being at least $10^{12}$ Ω·cm, and more preferably being in the range of $10^{14}$ to $10^{15}$ Ω·cm. Chargeability of the resin particles can be controlled by material selection and intervening other above-mentioned components.

The resin particles preferably retain ink well by receiving ink. In the present invention, it is preferable for the resin particles to be melted by heat when the resin particle layer is transferred to the recording medium, so that the layer is easily transferred to and fixed on the recording medium to form a transfer image. In the present invention, it is preferable for the resin particle layer on the surface of the recording medium to be melted by heat, to thereby easily fix the layer on the recording medium to form a fixed image.

Any particles can be used as the resin particles in the present invention, as long as the particles are fine and made of a water-insoluble thermoplastic resin. When porous particles are used, ink is retained not only in cavities formed between the resin particles but also in the pores of the resin particles themselves, whereby ink retentivity of the resin particle layer is further improved and it becomes possible for a thin resin particle layer to retain more ink. By reducing the thickness of the resin particle layer, not only is transfer of the image facilitated but an image recording material can be obtained without the flexibility and surface properties of the original recording medium adversely affected.

Examples of specific materials of fine particles made of thermoplastic resin and usable as the resin particles of the present invention include polyethylene, polypropylene, polyvinyl acetate, polyvinyl alcohol, polyvinyl acetal, poly (meth)acrylic acid, poly(meth)acrylate, polyacrylic acid derivative, polyacrylic amide, polyether, polyester, polycarbonate, cellulose-based resin, polyacrylonitrile, polyimide, polyamide, polyvinyl chloride, polyvinylidene chloride, polystyrene, thiocol, polysulfone, polyurethane, polystyrene, homopolymers and copolymers of hydrophilic monomers such as acrylic acid, methacrylic acid, vinylpyrrolidone, acrylamide and methacrylamide; copolymers with a monomer such as styrene, acrylate and methacrylate; water-soluble polyester, polyvinyl alcohol and hydroxyethylcellulose; and other copolymers of these resins.

In the present invention, it is preferable to use fine thermoplastic resin particles made of polyester, polystyrene, nylon 6 and nylon 12, and copolymers thereof. The particles may also be mixed with a conventional binder used in toners for electrophotography. When fine particles made of these materials is used as the resin particles, color development of coloring agents in the ink by inkjet recording becomes excellent, and a particularly clear image can be obtained.

Examples of charge controlling agents that can be added to the resin particles include nigrosine dyes, fatty acid metal salts and azo-based alloy dyes. Examples of other additives that can be added include colloidal silica, alumina, metal soaps and polyvinylidend fluoride.

Examples of the solid fine particles that can be internally or externally added to the resin particles include commonly known inorganic and organic fine particles.

Examples of the inorganic fine particles include white inorganic pigments such as calcium carbonate (light calcium carbonate and heavy calcium carbonate), magnesium carbonate, kaolin, clay, talc, calcium sulfate, barium sulfate, titanium dioxide, zinc oxide, zinc hydroxide, zinc sulfide, zinc carbonate, hydrotalcite, aluminum silicate, diatomaceous earth, calcium silicate, magnesium silicate, silica (synthetic amorphous silica and colloidal silica, and the like), alumina, alumina hydrate, colloidal alumina, pseudo boehmite, aluminum hydroxide, lithopone, zeolite and magnesium hydroxide, and other inorganic pigments.

These inorganic pigments may be used in the form of primary particles uniformly dispersed in the resin particles or in the form of secondary coagulated particles dispersed in a binder.

Examples of the organic fine particles include polystyrenes, polyacrylates, polymethacrylates, polyacrylamides, polyethylene, polypropylene, polyvinyl chloride, polyvinylidene chloride, or copolymers thereof, urea resin, or melamine resins and the like.

In the present invention, it is preferable to use at least one type of inorganic fine particles selected from the group consisting of alumina fine particles, alumina hydrate fine particles, silica fine particles and calcium carbonate, from the standpoint of achieving high concentration, recording a clear image and lowering production costs.

The alumina or alumina hydrate fine particles preferably comprise porous alumina or its hydrate having a radius of 3 to 10 nm and a sum pore volume of 0.2 to 2 ml/g. Pore volume can measured by commonly known nitrogen adsorption methods with respect to the dried solid content of the alumina or alumina hydrate fine particles.

The alumina or alumina hydrate fine particles may be crystalline or non-crystalline, and particles of any shape can be used, such as amorphous particles, spherical particles or needle-shaped particles.

Various silica fine particles conventionally known in the field of inkjet recording can be used as the silica fine particles in the present invention. For example, synthetic silica synthesized by a wet or gas-phase method, colloidal silica, porous silica containing secondary particles formed by coagulation of primary particles, and silica of any shape, can be used. Examples of the silica fine particles include the synthetic amorphous silica described in JP-A Nos. 55-51583 and 56-148583; the silica ultrafine particles synthesized by a gas-phase method described in JP-A No. 60-204390; the synthetic amorphous silica containing fluorine described in JP-A No. 60-222282; the synthetic amorphous silica surface-treated with a silane coupling agent described in JP-A Nos. 60-224580 and 62-178384; the spherical silica described in JP-A Nos. 62-183382 and 63-104878; the synthetic silica fine particles having a $Na_2O$ content of at least 0.5% by weight described in JP-A No. 63-317381; the synthetic silica fine particles having a specific surface area of at least 100 $m^{2/}g$ described in JP-A No. 1-115677; the synthetic silica fine particles surface-treated with alumina described in JP-A No. 62-286787; the synthetic silica fine particles surface-treated with Ca, Mg or Ba, and synthetic silica fine particles having an oil absorption of at least 180 ml/g described in JP-A No. 1-259982; the colloidal silica described in JP-A No. 57-14091; the cationic colloidal silica described in JP-A Nos. 60-219084, 6-92011, 6-297830 and 7-81214; and the moniliformly-connected or branched colloidal silica described in JP-A Nos. 5-278324 and 7-81214.

However, in order to obtain high image gloss and high cavity volume, it is preferable to use silica ultrafine particles having an average particle size of 7 to 30 nm. The silica fine particles may have cation-denaturated surfaces, or be treated with Al, Ca, Mg, Ba or the like.

Examples of calcium carbonates preferably used in the present invention include the light calcium carbonates having a particular specific surface area described in JP-A Nos. 57-120486, 57-129778, 58-55293 and 61-20792; the needle-shaped calcium carbonates described in JP-A Nos. 63-57277 and 4-250091; the calcium carbonate fine particles containing secondary particles formed by coagulation of specific needle-shaped primary particles described in JP-A No. 3-251487; the rhombic algodonite calcium carbonate in the form of needle having a specific oil absorption described in JP-A Nos. 4-250091 and 4-260092; and the spherical precipitated calcium carbonate described in JP-A No. 7-40648.

When calcium carbonate is added to the resin particles of the present invention, it is preferable to use calcium carbonate fine particles having diameters of about 0.1 $\mu$m or less, and particularly preferable to use calcium carbonate fine particles having an average particle size of 10 to 50 nm, from the standpoint of obtaining high image gloss and high cavity volume.

There are no particular limitations on how the resin particles are produced. The resin particles can be produced, for example, by grinding methods or polymerization methods commonly known in the production of toners in electrophotography.

In the grinding methods, the above-mentioned constituent components other than external additives are melted and mixed, and then ground and classified to produce the resin particles. Specifically, resins and other additives are mixed in the form of powder and sufficient heat is applied to melt the resin Shearing force is then applied to disperse the additives in the resin and the melted and mixed material is cooled, ground and classified, Thus, resin particles having an intended particle size and particle size distribution can be obtained.

In the polymerization methods, independent polymer particles are formed from a monomer, other additives are incorporated into or compounded with the polymer particles to obtain resin particles. Representative examples of such polymerization methods include suspension polymerization and emulsion polymerization and coagulation. These polymerization methods are characterized in that typical physical properties of the resin particles to be obtained, such as sharp particle size distribution and particle shape (e.g., from spherical to, if necessary, elliptical), can be controlled by optimizing production conditions.

There are no particular limitations on the shape of the resin particles. An amorphous shape having a large surface area is preferable since it is preferable for the resin particles themselves to have fine pores However, spherical particles obtained by the foregoing polymerization methods can also be preferably used in view of being able to control the precision of the ink image.

It addition to being meltable by heat, it is also preferable for the resin particles to include a foaming agent. By incorporating a foaming agent in the resin particles, the foaming agent foams in a pre-heating step (described later), whereby cavities are created in the resin particles themselves and cavity area for retaining the ink image recorded by inkjet recording in the recording step can be increased.

Examples of such foaming agents include foaming agents comprising microcapsule particles (hereinafter, may be referred to as a microcapsule foaming agent) including a substance having a low boiling point and vaporizing at a low temperature (the substance may be liquid or solid at room temperature). Microcapsule foaming agents are preferable because their foaming properties are high. It is necessary for the low boiling point substance included in the microcapsule particles to vaporize at a temperature at least lower than the temperature at which preheating is conducted in the preheating step. Specifically, the substance preferably vaporizes at 100° C. or less, more preferably 50° C. or less, and even more preferably 25° C. or less. However, since the heat responsiveness of the microcapsule foaming agent depends not only on the boiling point of the low boiling point substance that is the core material but also on the softening point of the wall material, the preferable boiling point range of the low boiling point substance is not restricted to the above.

Examples of the low boiling point substance include neopentane, neohexane, isopentane, isobutylene and isobutane. Isobutane that is stable for the wall material of the microcapsule particles and has a high coefficient of thermal expansion is preferable.

It is preferable for the wall material of the microcapsule particles in the microcapsule foaming agent to be resistant to various solvents used in the production of the resin particles, and to be non-permeable to gas generated when the low boiling point substance included in the microcapsule particles vaporizes. It is also necessary for the wall material to soften and expand at a temperature lower than the temperature at which preheating is conducted in the preheating step.

Materials conventionally used as wall materials of microcapsules can generally be widely used. Examples thereof include homopolymers such as polyvinyl chloride, polyvinyl acetate, polystyrene, polyacrylonitrile, polybutadiene and polyacrylate, and copolymers thereof, can be preferably used. In particular, a copolymer of vinylidene chloride and acrylonitrile is preferable since adhesion with the resin in the resin particles is high and solvent-resistance is high.

The amount of the foaming agent included in the resin particles of the present invention is usually 5% by weight to 50% by weight, and preferably lot by weight to 40% by weight, though the preferable range differs depending on the kind of foaming agent used. When the amount of the foaming agent is less than 5% by weight, beat expansion of the resin particles may be practically insufficient. When the amount of the foaming agent exceeds 50% by weight, problems such as the ratio of the thermoplastic resin in the resin particles being relatively deficient and inability to obtain sufficient fixability may arise.

The volume-average particle size of the resin particles is, from the standpoint of ink retentivity and image clearness, preferably in the range of 0.5 to 100 $\mu$m, more preferably 1.0 to 50 $\mu$m, further preferably 1.0 to 20 $\mu$m. and particularly preferably from 3 to 15 $\mu$m. When the particle size of the resin particles is too small, the cavities between the resin particles are too fine and sufficient ink retentivity becomes difficult to obtain, and there is also the potential for flowability of the resin particles to worsen and for chargeability before the resin particles are formed to drop, whereby it becomes difficult to form a uniform resin particle layer on the surface of the intermediate transfer medium or the recording medium, when the particle size of the resin particles is too large, the cavities between resin particles becomes too large and resolution of the image decreases, whereby a clear image may not be obtainable.

The particle diameter D ($\mu$m) of the resin particles has a significant relation with the amount of ink jetted per unit area V ($\mu g/mm^2$) from the inkjet recording head in the recording step, ink droplet size Vd (ng/dot) and recording speed f (KHz). Preferably, the larger that $f \cdot V \cdot Vd$ is, the smaller, that D becomes.

It is further preferable to use as the resin particles a material that enables fixation technology used in electrophotography technology to be applied in the fixing step or the transferring and fixing step after the image is formed by the inkjet recording head. From this standpoint, the thermoplastic resin used in the resin particles has a melting point preferably in the range of 70 to 200° C., more preferably 80 to 180° C., and further preferably 100 to 150° C.

When a material having a melting point lower than 70° C. is used, there is the potential for the resin particles to melt and for blocking to occur, depending on conditions at the time of physical distribution or storage. When a material having a melting point exceeding 200° C. is used, problems may arise in that not only does high energy become necessary in transfer but the selection range of heat-resistant materials applicable to a transferring and fixing apparatus becomes extremely restricted. As a result, the apparatus increases in size and it becomes difficult to easily transfer and fix the image on the recording material.

The resin particle layer preferably has a thickness in the range of 1 to 100 $\mu$m. more preferably 5 to 50 $\mu$m, and even more preferably 10 to 30 $\mu$m. The amount of resin particles adhering to the surface of the intermediate transfer medium or recording medium may also be controlled in accordance with amount of ink jetted during inkjet recording the recording step, specifically, it is preferable to increase the adhesion amount when the amount of ink jetted is too large and to reduce the adhesion amount when the ink injection amount is too small.

The thickness of the resin particle layer that can be stably formed on the surface of the intermediate transfer medium or recording medium is limited. When the layer is too thick, problems may arise, such as: a large amount of energy becomes necessary to transfer and fix (or only fix) the layer after the layer has been formed; rigidity and flexibility of the recording medium after the layer has been transferred to and fixed (or only fixed) thereon may significantly differ from rigidity and flexibility prior to the layer being transferred and fixed (or only fixed); and deteriorated image quality. When the layer is too thin, the thickness of parts having cavities for retaining the ink also becomes thin, whereby the ink is not sufficiently retained and it becomes difficult to form a highly precise image.

Resin particles that include a releasing agent can also be used. Examples of such resin particles include: waxes, such as carnauba wax, paraffin wax, micro crystalline wax and castor wax; higher fatty acids or derivatives thereof like metal salts and esters, such as stearic acid, palmitic acid, lauric acid, aluminum stearate, lead stearate, barium stearate, zinc stearate, zinc palmitate, methylhydroxystearate, glycerol monohydroxystearate and glycerol monohydroxystearate; polyamide-based resins, petroleum-based resins, rosin derivatives, coumarone-indene resins, terpene-based resins, novolak-based resins, styrene-based resins, and olefin-based resins such as polyethylene, polypropylene, polybutene, oxidated polyolefins and vinyl ether-based resins.

There are no particular limitations on how the resin particle layer is formed. For example, it is possible to use chargeable resin particles, to charge the resin particles triboelectrically, and to form the layer on the surface of the intermediate transfer medium or recording medium by transferring the resin particles thereto by an electric field. In this case, a chargeable insulating material is used for the resin particles, and the particles are charged by rubbing them against each other by stirring.

In the case of the intermediate transfer medium, the surface thereof is pre-charged to a polarity opposite the polarity of the resin particles, and the charged resin particles are brought into contact with or close to the surface of the intermediate transfer medium, whereby the resin particles are electrostatically attracted to and deposited on the intermediate transfer medium to form the resin particle layer. In the case of the recording medium, the resin particles are electrostatically attracted from the reverse surface of the recording medium when the charged resin particles are brought into contact with or close to the surface of the recording medium, whereby the resin particles are deposited on the recording medium to form the resin particle layer. This latter method may also be applied to the intermediate transfer medium.

Forming the resin particle layer by electrostatic transfer is applied in the field of electrophotography when a toner is developed on the surface of a photosensitive body or transferred from a surface of a photosensitive body to a surface of a transfer medium.

There are no particular limitations on how the surface of the intermediate transfer medium is charged to reversed polarity. The surface may be charged by, for example, applying voltage to a conductive rubber roller contacting the intermediate transfer medium or by imparting bias potential to a conductive layer disposed on the intermediate transfer medium. The surface of the intermediate transfer medium may be charged by any method as long as the surface is charged to the necessary potential level.

When the resin particles are triboelectrically charged, a material having the same function as that of the carrier employed in the field of electrophotography may also be used. The charging amount of the resin particles is preferably in the range of 10 $\mu$c/g to 50 $\mu$c/g.

Further, in the present invention, it is preferable to form the resin particle layer by a method that employs a photosensitive body and is commonly known in the field of electrophotography. Specifically, the resin particle layer is preferably formed by the steps of:

(1) charging a surface of a photosensitive body;

(2) exposing the surface of the photosensitive body;

(3) adhering the triboelectrically charged resin particles to the exposed region of the surface of the photosensitive body; and (4) transferring the resin particles adhering to the surface of the photosensitive body to the surface of the intermediate transfer medium or recording medium by an a electric field.

In the present invention, methods and conditions commonly known in the field of electrophotography can be applied without problem to the preceding steps (1) to (4).

In the charging step (1), the surface of the photosensitive body is uniformly charged by a commonly known contacting or non-contacting charger. When negatively chargeable resin particles are to be used, the surface of the photosensitive body is charged negatively.

In the exposure step (2), the region of the surface of the photosensitive body on which the resin particle layer is to be formed is exposed. This region may be the entire surface of the intermediate transfer medium or recording medium, or only the region (image site) or the image site and peripheral regions thereof that is/are inkjet-recorded in the recording step, In the latter case, the resin particle layer may be formed only at the image site or may extend slightly beyond the perimeter of the image site. By forming the resin particle layer only at the image site or also at the peripheral regions thereof, the amount of the resin particles used can be reduced, which is not only cost-effective but reduces the capacity of tanks for supplying the resin particles in the image forming apparatus of the present invention, whereby it becomes possible to make the apparatus compact.

In order to form the resin particle layer only at the image site or peripheral regions thereof, it is preferable to expose the surface of the photosensitive body on the basis of image signals during the exposure step so that the exposed region corresponds to the image or periphery thereof image. In the present invention, although the recording of the image itself is conducted by inkjet recording during the recording step, the resin particle layer can be easily formed at a desired region if image information inputted for recording in the recording step is also appropriated to set the exposure region in the exposure step.

Though description has mainly been given of development in which insulating particles are used as the resin particles, conductive resin particles can be adhered to the intermediate transfer medium or recording medium in the same manner as in development of conventionally known conductive toners.

In the present invention, the resin particle layer is formed on the intermediate transfer medium. The intermediate transfer medium may be cylindrical or in the form of an endless belt, but preferably in the form of endless belt in view of the ease with which the apparatus can be designed and reducing the size of the apparatus.

When the intermediate transfer medium is cylindrical, the intermediate transfer medium preferably comprises a cylindrical metal substrate having disposed thereon at least a releasing layer. When the intermediate transfer medium is in the form of an endless belt, the intermediate transfer medium preferably includes at least a base layer and a releasing layer. By disposing a releasing layer, the resin particle layer can efficiently and easily be transferred to and fixed on the surface of the recording medium to form an image. For example, in a case where the recording medium is to be stripped from the intermediate transfer medium after the resin particle layer disposed on the surface of the intermediate transfer medium and having the image formed thereon has been transferred to and fixed on the surface of the recording medium, the releasing layer can effectively prevent the image from being corrupted due to, for example, the recording medium winding around the intermediate transfer medium, the transferred resin particle layer being stripped together with the intermediate transfer medium, or part of the transfer layer remaining on the base material.

Examples of material used for the releasing layer include silicone rubber, silicone resin, silicon copolymer, fluorosilicone resin, fluorine resins (e.g., tetrafluoroethylene perfluoroalkyl vinyl ether copolymer and polytetrafluoroethylene) and fluorine rubber. Although there are no limitations on the thickness of the releasing layer, it is preferably in the range of 1 to 300 $\mu$m.

When the intermediate transfer medium is in the form of an endless belt, any base material (base layer) can be used for holding the releasing layer as long as repeated cyclic conveyance within the apparatus is possible and the base material has heat-resistance necessary when the resin particle layer is transferred and fixed. Specific examples thereof include flexible base materials like resins having high heat resistance, such as polyimide resin film, polycarbonate resin film, polyester, polyethylene terephthalate, polyether sulfone, polyether ketone, polusulfane, polyimide, polyimideamide and polyamide, and thin metal films of nickel and stainless steel.

By using a flexible base material in the intermediate transfer medium, it is possible to dispose the intermediate transfer medium on a tensile roller having a small diameter and to smoothly convey the medium. Moreover, because the intermediate transfer medium wound on a tensile roller made of an elastic body can be closely adhered to the elastic roller and deformed therewith, the efficiency with which the resin particle layer can be transferred to and fixed on the recording medium is high. Thus, even if non-planar recording paper (e.g., embossed paper or the like) is used as the recording medium, it is possible to form an excellent transfer image. Moreover, a conductive material such as carbon black can be dispersed to prevent charge.

When the flexibility of the base material is insufficient, an elastic layer may be disposed between the base material and the releasing layer. Although there are no particular limitations on the thickness of the elastic layer, it is preferably in the range of 30 $\mu$m to 300 $\mu$m in view of surface unevenness of the recording paper. Silicone rubber is optimum as the material for the elastic layer.

The thickness of the base material (base layer) of the intermediate transfer medium in the form of the endless belt is preferably in a range in which rigidity and flexibility are made compatible to enable repeated cycle conveyance, i.e., preferably 10 to 200 $\mu$m, and more preferably 30 to 100 $\mu$m. When the thickness is less than 30 $\mu$m, rigidity may be weak, wrinkles may be formed during cyclic conveyance and cracks may be formed in edges at both ends of the intermediate transfer medium. When the thickness exceeds 200 $\mu$m, flexibility may not be secured.

There are no particular limitations on how the releasing layer and elastic layer are formed on the surface of the base material. For example, materials suitable for the releasing layer and elastic layer may be dissolved or dispersed in a solvent to prepare a coating solution, with the coating solution then being coated and baked. Alternatively, a film may be formed from materials suitable for the releasing layer and elastic layer and then laminated on the surface of the base material. Extrusion molding or other methods can also be used.

The coating solution may be coated by, for example, a roller coater, a blade coater, an air knife coater, a gate roller coater, a bar coater, a size press, a shim sizer, a spray coater, a gravure coater, or a curtain coater.

When the resin particle layer on the surface of the intermediate transfer medium is heated or pre-heated by electromagnetic induction in the step of heating or the step of preheating, the intermediate transfer medium may include a heat-generating layer. The resin particle layer can thus be heated or pre-heated by heating the heat-generating layer in the intermediate transfer medium by electromagnetic induction, A metal that creates electromagnetic induction action is used in the heat-generating layer. Examples of the include nickel, iron, copper, gold, silver, aluminum, steel and chromium, copper, nickel, aluminum and iron are suitable when cost, heat-generating ability and processability are taken into account, but copper is particularly preferable. It should be noted that when a thin metal film is used as the base layer, the metal itself can serve as the heat-generating layer. Thus, it may not be necessary to dispose a heat-generating layer. Such a base layer is referred to as the heat-generating layer in the present invention.

The principle of heating the heat-generating layer by electromagnetic induction (hereinafter, simply referred to as "electromagnetic induction heating" in some cases) will be described later.

In the present invention, the resin particle layer is formed directly on the recording medium. There are no particular limitations on the recording medium, as long as it has heat resistance necessary in the fixing. This is because a recording medium having a surface suitable for inkjet recording is created even if the resin particle layer is disposed on the surface of a recording medium that has a surface initially ill-suited for inkjet recording.

Specifically, all kinds of recording media, such as plain paper, OHP paper, copy paper, rough writing paper, coated paper, drawing paper and cardboard can be used. However, inkjet recording paper may of course also be used.

Step of Recording

In the recording step, ink is jetted from the inkjet recording head onto the resin particle layer formed on the surface of the intermediate transfer medium or recording medium, whereby the cavities in the resin particle layer retain the ink and the image is recorded (this recording process may be referred to simply as "inkjet recording" later).

Various inks conventionally used in inkjet recording can be used without problem in the present invention. The ink generally includes at least a coloring agent, water-soluble organic solvent and water, and may include other components as needed.

(Water-Soluble Organic Solvent)

Examples of the water-soluble organic solvent included in the ink include polyvalent alcohols such as ethylene glycol, diethylene glycol, propylene glycol, butylenes glycol, triethylene glycol, 1,5-pentanediol, 1,2,6-hexanetriol and glycerin, polyvalent alcohol derivatives such as ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, diethylene glycol monohexyl ether, triethylene glycol monobutyl ether, propylene glycol monobutyl ether and dipropylene glycol monobutyl ether, nitrogen-containing solvents such as pyrrolidone, N-methyl-2-pyrrolidone, cyclohexylpyrrolidone and triethanolamine, alcohols such as ethanol, isopropyl alcohol, butyl alcohol and benzyl alcohol, sulfur-containing solvents such as thiodiethanol, thiodiglycerol, sulfolane and dimethylsulfoxide, propylene carbonate, ethylene carbonate, 1,1,1-tris(hydroxymethyl)propane, monosaccharides, oligosaccharides and sugar-alcohols.

These water-soluble organic solvents may be used singly or in combination of two or more. Although there are no particular limitations on the amount of the water-soluble organic solvent included in the ink, the amount is preferably 5 to 60% by weight and more preferably 5 to 40% by weight, based on the total weight of the ink.

(Water)

Although any general water can be included in the ink, it is preferable to use ion-exchange water, ultrapure water, distilled water or ultrafiltration water to prevent impurities from being incorporated in the ink.

(Coloring Agent)

The coloring agent included in the ink may be a dye or a pigment. When a dye is used, clogging of the recording head nozzle is suppressed. In the present invention, because the ink image is incorporated into the resin by melting the resin particles after fixing and transferring (or just fixing), whereby the image is protected by the resin, poor weather-resistance (e.g., resistance to water light and ozone) inherent to dye ink is improved remarkably when a dye ink is used. When a pigment is used, good weather-resistance inherent to the pigment itself is further improved by the resin protection.

Examples of the dye included in the ink include direct dyes, acidic dyes, edible dyes, basic dyes, reactive dyes, dispersion dyes, vat dyeing dyes, soluble vat dyeing dyes, reactive dispersion dyes and oily dyes. A water-soluble anionic dye is preferably used in the present invention.

Specific examples of the water-soluble anionic dye include:

- C. I. Direct Black-2, -4, -9, -11, -17, -19, -22, -32, -80, -151, -154, -168, -171, -194, -195;
- C. I. Direct Blue-1, -2, -6, -8, -22, -34, -70, -71, -76, -78, -86, -112, -142, -165, -199, -200, -201, -202, -203, -207, -218, -236, -287, -307;
- C. I. Direct Red-1, -2, -4, -8, -9, -11, -13, -15, -20, -28, -31, -33, -37, -39, -51, -59, -62, -63, -73, -75, -80, -81, -83, -87, -90, -94, -95, -99, -101, -110, -189, -227;
- C. I. Direct violet-2, -5, -9, -12, -18, -25, -37, -43, -66, -72, -76, -84, -92, -107;
- C. I. Direct Yellow-1, -2, -4, -8, -11, -12, -26, -27, -28, -33, -34, -41, -44, -48, -58, -86, -87, -88, -132, -135, -142, -144, -173;
- C. I. Food Black-1, -2;
- C. I. Acid Black-1, -2, -7, -16, -24, -26, -28, -31, -48, -52, -63, -107, -112, -119, -119, -121, -156, -172, -194, -208;
- C. I. Acid Blue-1, -7, -9, -15, -22, -23, -27, -29, -40, -43, -55, -59, -62, -78, -80, -81, -93, -90, -102, -104, -111, -185, -249, -254;
- C. I. Acid Red-1, -4, -8, -13, -14, -15, -18, -21, -26, -35, -37, -52, -110, -144, -180, -249, -257;
- C. I. Acid Yellow-1, -3, -4, -7, -11, -12, -13, -14, -18, -19, -23, -25, -34, -38, -41, -42, -44, -53, -55, -61, -71, -76, -78, -79, -122, and also dyes having a structure represented in the following general formula (I) or the general formula (II).

General Formula (I)

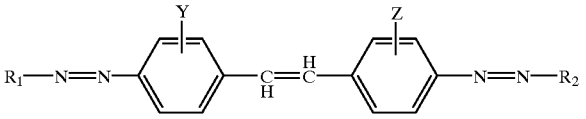

(In general formula (I), each of $R_1$ and $R_2$ independently represents a group having the following formula (1) or formula (2), and each of Y and Z independently represents a hydrogen atom or —$SO_2M$. M represents a counter ion selected from the group consisting of alkali metal ions, ammonium ions and substituted ammonium ions.)

(1)

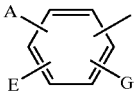

(2)

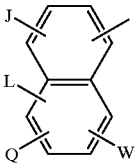

(In formulae (1) and (2), each of A, E and G independently represents a group selected from the group consisting of a hydrogen atom, alkyl group, —OH group and —COOM. Each of J, L, Q and W independently represents a group selected from the group consisting of a hydrogen atom, —OH, —$NH_2$ and —$SO_3M$. M represents a counter ion selected from the group consisting of alkali metal ions, ammonium ionx and substituted ammonium ions.)

General Formula (II)

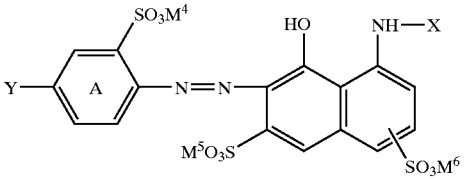

(In general formula (II), Y represents a hydrogen atom, methyl group, methoxy group, acetylamino group or nitro group, and may further form a benzene ring together with a carbon atom at 3-position of a benzene ring A. X represents an acetyl group, benzoyl group, p-toluenesulfonyl group or 4-chloro-6-hydroxy-1,3,5-triazin-2-yl group. M4, M5 and M6 represent a counter ion, and each is a base selected from alkali metals, ammonium and amines.)

These dyes may be used singly or in combination of two or more. The amount of the dye (s) included in the ink is preferably from 0.1 to 10% by weight and more preferably from 0.1 to 4% by weight, based on the total weight of the ink.

Examples of the pigment included in the ink include organic pigments and inorganic pigments.

Examples of black pigments include carbon black pigments such as furnace black, lamp black, acetylene black and channel black. Specific examples thereof include, but are not limited to; Raven 7000, Raven, 5750, Raven 5250, Raven 5000 ULTRAII, Raven 3500, Raven 2000, Raven 1500, Raven 1250, Raven 1200, Raven 1190, ULTRAII, Raven-1170, Raven 1255,-Raven 1080, Raven 1060 (all manufactured by Columbian Carbon, Ltd.); Regal 1400R, Regal 1330R, Regal 1660R, Mogul L, Black Pearls L, Monarch 700, Monarch 800, Monarch 880, Monarch 900, Monarch 1000, Monarch 1100, Monarch 1300, Monarch 1400 (all manufactured by Cabot Corporation); Color Black FW1, Color Black FW2, Color Black FW2V, Color Black 18, Color Black FW200, Color Black S150, Color Black S160, Color Black S170, Printex 35, Printex U, Printex V, Printex 140U, Printex 140V, Special Black 6, Special Black 5, Special Black 4A, Special Black 4 (all manufactured by Degussa Corporation); and No. 25. No. 33, No. 40, No. 47, No. 52, No. 900, No. 2300, MCF-88, MA600, MA7, MA8, MA100 (all manufactured by Mitsubishi Chemical Co., Ltd.).

Examples of cyan pigments include, but are not limited to, C. I. Pigment Blue-1, C. I. Pigment Blue-2, C. I. Pigment Blue-3, C. I. Pigment Blue-15, C. I. Pigment Blue-15:1, C. I. Pigment Blue-15:3, C. I. Pigment Blue-15:34, C. I. Pigment Blue-16, C. I. Pigment Blue-22 and C. I. Pigment Blue-60.

Examples of magenta pigments include, but are not limited to, C. I. Pigment Red-5, C. I. Pigment Red-7, C. I. Pigment Red-12, C. I. Pigment Red-48, C. I. Pigment Red-48:1, C. I. Pigment Red-57, C. I. Pigment Red-112, C. I. Pigment Red-122, C. I. Pigment Red-123, C. I. Pigment Red-146, C. I. Pigment Red-168, C. I. Pigment Red-184 and C. I. Pigment Red-202.

Examples of yellow pigments include, but not limited to, C. I. Pigment Yellow-1, C. I. Pigment Yellow-2, C. I. Pigment Yellow-3, C. I. Pigment Yellow-12, C. I. Pigment Yellow-13, C. I. Pigment Yellow-14, C. I. Pigment Yellow-16, C. I. Pigment Yellow-17, C. I. Pigment Yellow-73, C. I. Pigment Yellow-74, C. I. Pigment Yellow-75, C. I. Pigment Yellow-83, C. I. Pigment Yellow-93, C. I. Pigment Yellow-95, C. I. Pigment Yellow-97, C. I. Pigment Yellow-98, C. I. Pigment Yellow-114, C. I. Pigment Yellow-128, C. I. Pigment Yellow-129, C. I. Pigment Yellow-151 and C. I. Pigment Yellow-154.

In addition to black and the three primary colors of cyan, magenta and yellow, pigments of other colors, such as red, green, blue, brown and white, metallic luster pigments, such as gold and silver, colorless or pale color extender pigments, plastic pigments and newly synthesized pigments may also be used.

These pigments may be used singly or in combination of two or more. The amount of the pigment(s) included in the ink is preferably 0.5 to 20% by weight and more preferably 2 to 10% by weight, based on the total weight 3 of the ink.

(Pigment Dispersing Agent)

When a pigment is used, it is preferable to also use a pigment dispersing agent. Examples of the pigment dispersing agent include polymer dispersing agents, anionic surfactants, cationic surfactants, ampholytic surfactants and nonionic surfactants.

Polymers having a hydrophilic component and a hydrophobic component can be effectively used as the pigment dispersing agent. Examples thereof include condensation polymers and addition polymers. As the condensation polymer, known polyester-based dispersing agents can be used. As the addition type polymer, addition polymers of monomers having an α,β-ethylenically unsaturated group can be used. A monomer having an α,β-ethylenically unsaturated group having a hydrophilic group and a monomer having an α,β-ethylenically unsaturated group having a hydrophobic group can be appropriately combined and copolymerized to obtain the polymer dispersing agent. Further, a homopolymer of a monomer having an α,β-ethylenically unsaturated group having a hydrophilic group can also be used.

Examples of the monomer having an α,β-ethylenically unsaturated group having a hydrophilic group include monomers having a carboxyl group, sulfonate group, hydroxyl group, phosphate group and the like, for example, acrylic acid, methacrylic acid, crotonic acid, itaconic acid, itaconate monoester, maleic acid, maleate monoester, fumaric acid, fumarate monoester, vinylsulfonic acid, styrenesulfonic acid, sulfonated vinylnaphthalene, vinyl alcohol, acrylamide, methacryloxyethyl phosphate, bismethacryloxyethyl phosphate, methacryloxyethylphenylacid phosphate, ethylene glycol dimethacrylate and diethylene glycol dimethacrylate.

Examples of the monomer having an α,β-ethylenically unsaturated group having a hydrophobic group include styrene, styrene derivatives such as α-methylstyrene and vinyltoluene, vinylcyclohexane, vinylnaphthalene, vinylnaphthalene derivatives, alkyl acrylate, alkyl methacrylate, phenyl methacryalate, cycloalkyl methacrylates, alkyl crotonates, dialkyl itaconates and dialkyl maleates.

Preferable examples of the copolymer include a styrene-styrenesulfonic acid copolymer, styrene-maleic acid copolymer, styrene-methacrylic acid copolymer, styrene-acrylic acid copolymer, vinylnaphthalene-maleic acid copolymer, vinylnaphthalene-methacrylic acid copolymer, vinylnaphthalene-acrylic acid copolymer, alkyl acrylate-acrylic acid copolymer, alkyl methacrylate-methacrylic acid copolymer, styrene-alkyl methacrylate-methacrylic acid copolymer, styrene-alkyl acrylate-acrylic acid copolymer, styrene-phenyl methacryalte-methacrylic acid copolymer, and a styrene-cyclohexyl methacrylate-methacrylic acid copolymer. These polymers may be copolymerized with a monomer having a polyoxyethylene group or a hydroxyl group.

The copolymer may have a random, block or graft structure. Additionally, polystyrenesulfonic acid, polyacrylic acid, polymethacrylic acid, polyvinylsulfonic acid, polyalginic acid, polyoxyethylene-polyoxypropylene-polyoxyethylene block copolymer, formalin condensate of naphthalenesulfonic acid, polyvinylpyrrolidone, polyethyleneimine, polyamines, polyamides, polyvinylimidazoline, aminoalkyl acrylate acrylamide copolymer, chitosan, polyoxyethylene fatty amide, polyvinyl alcohol, polyacrylamide, cellulose derivatives such as carboxymethylcellulose and carboxylethylcellulose, and polysaccharides and derivatives thereof can also be used.

Although there are no particular limitations thereon, the hydrophilic group of the pigment dispersing agent is preferably an acidic group, and more preferably a carboxylic acid or a salt of carboxylic acid. The reasons for this are understood to be because a carboxyl group forms a cross-linked with a polyvalent metal ion and because the pigment assumes a suitable coagulated structure.

Polymer having an acidic hydrophilic group are preferably used in the form of a salt with a basic compound in order to raise solubility in water. Examples of the compound forming a salt with these polymers include alkali metals, such as sodium, potassium and lithium, aliphatic amines, such as monomethylamine, dimethylamine and triethylamine, alcoholamines, such as monomethanolamine, monoethanolamine, diethanolamine, triethanolamine and diisopropanolamine, and ammonia. Preferably, basic compounds of alkali metals such as sodium, potassium and lithium are used. This is because basic compounds of alkali metals are strong electrolytes and largely promote decomposition of the acidic group.

Preferably, at least 50%, and more preferably at least 80%, of the pigment dispersing agent is neutralized based on the acid value of the copolymer.

The pigment dispersing agents may be used singly or in combination of two or more. The amount of the pigment dispersing agent added cannot be specified unconditionally because the amount added will vary widely depending on the kind of pigment used. However, the amount is generally added at a ratio of 0.1 to 100% by weight, preferably 1 to 70% by weight, and more preferably 3 to 50% by weight in total.

(Surfactant)

Cationic surfactants, nonionic surfactants or anionic surfactants may also be added to the ink in order to regulate surface tension and wettability of the ink or to render organic impurities soluble to thereby improve the reliability with which the ink is jetted from the inkjet nozzle. These surfactants may be used singly or in combination of two or more. The amount of the surfactant(s) added is preferably 5% by weight or less, and more preferably in the range of 0.01 to 3% by weight, based on the total amount of ink.

(Other Components)

Components other than the above components may also be added to the ink to control ink properties. Examples thereof include polyethyleneimine, polyvinylpyrrolidone, polyethylene glycol, cellulose derivatives, such as ethylcellulose and carboxymethylcellulose, and other water-soluble polymers; polymer emulsions such as acrylic polymer emulsions and polyurethane-based emulsions; cyclodextrin, macrocyclic amines, dendrimer, crown ethers, urea and derivatives thereof, and acetamide.

Moreover, in order to control conductivity and pH, the ink can also include: compounds of alkali metals, such as potassium hydroxide, sodium hydroxide and lithium hydroxide, nitrogen-containing compounds such as ammonium hydroxide, triethanolamine, diethanolamine, ethanolamine and 2-amino-2-methyl-1-propanol; compounds of alkaline earth metals, such as calciumbydroxide; acids, such as sulfuric acid, hydrochloric acid and nitric acid; and salts of strong acids with weak alkalis, such as ammonium sulfate.

In addition, pH buffers, antioxidants, anti-fungal agents, viscosity-controlling agents, conductive agents, ultraviolet absorbers, chelating agents, water-soluble dyes, dispersing dyes and oil-soluble dyes can also be added as needed to the ink.

The total amount of these additives included in the ink is preferably in the range of 0.01 to 10% by weight, and more preferably in the range of 0.01 to 5% by weight.

In the case of a dye ink, the ink is prepared by mixing and sufficiently stirring the aforementioned components. In the case of a pigment ink, the ink is prepared by, for example, adding a given amount of the pigment to an aqueous solution containing as needed a given amount of the pigment dispersing agent, sufficiently stirring the solution, dispersing the pigment with a dispersing machine, removing coarse particles by centrifugation or the like, adding a predetermined solvent or additives to the dispersion, mixing/stirring and then filtrating the dispersion. The pigment ink can also be prepared by creating a dense dispersion of the pigment and then diluting the dense dispersion. The pigment may also be ground before it is dispersed.

Any commercially available dispersing machine can be used, and examples thereof include colloid mills, flow jet mills, slasher mills, high speed dispersers, ball mills, attriters, sand mills, sand grinders, ultrafine mills, cigar motor mills, dino mills, pearl mills, agitator mills, cobol mills, triple rollers, twin rollers, extruders, kneaders, microfluidizers, laboratory homogenizers and ultrasonic homogenizers. These may be used alone or in combination. Alternatively, dispersion may be conducted by mixing given solvents, water and pigment dispersing agents, adding the pigment thereto and dispersing the pigment with a dispersing machine. In order to prevent inorganic impurities from being incorporated in the ink, it is preferable to disperse the pigment without using a dispersing medium. Suitable to this end is use of a microfluidizer or ultrasonic homogenizer.

Although there are no particular limitations on the pH of the ink, it is preferably 3 to 11 and more preferably 4.5 to 9.5. when the ink is one in which an anionic free group is present on the surface of the pigment, the pH is preferably in the range of 6 to 11, more preferably 6 to 9.5, and even more preferably 7.5 to 9.0. When the ink is one in which a cationic free group is present on the surface of the pigment, the pH is preferable in the range of 4.5 to 8.0, and more preferably 4.5 to 7.0.

In the inkjet recording of the recording step, the ink adheres to the resin particle layer formed on the surface of the intermediate transfer medium or recording medium to record an image. Specifically, ink droplets are jetted through an orifice in the inkjet recording head in accordance with recording signals to thereby form an image on the resin particle layer formed on the surface of the intermediate transfer medium or recording medium.

The inkjet recording may be conducted by any of several methods, such as using an electrostatic attractive force to jet the ink (charge control method), using vibrating pressure of a piezo element to jet the ink (pressure pulse method), or forming the ink droplets by utilizing pressure generated by the formation and growth of bubbles produced by heating the ink (thermal inkjet method). The thermal inkjet method is particularly preferable because full color images can be provided at a low cost with a small apparatus.

It is preferable to preheat the resin particle layer between the step of forming the resin particle layer and the step of recording. When the resin particle layer is formed, cavities between the resin particles in the layer are continuously connected. However, by preheating the resin particle layer, the resin particles are slightly melted, whereby the cavities are to a certain extent sealed to create independent cavities and prevent the ink from bleeding.

When the resin particles include a foaming agent, the cavity area for retaining the ink image can be increased by foaming the foaming agent in the preheating step to generate cavities in the resin particle themselves.

It is preferable that the preheating is conducted at a lower temperature than the temperature at which fixing is conducted during the step of fixing and transferring (or during the step of fixing). This is because the preheating serves to partially seal the cavities by melting only the surfaces of the resin particles and not to completely melt the resin particles and fix them under pressure.

In view of this, the resin particles are preheated in the preheating step at a temperature higher than the softening temperature of the resin by preferably 0 to 100° C., more preferably 20 to 70° C., preferably for 0.1 to 10 seconds, more preferably for 0.5 to 2 seconds.

In the present invention, the softening point is obtained by the following method of measurement.

Figure 2:
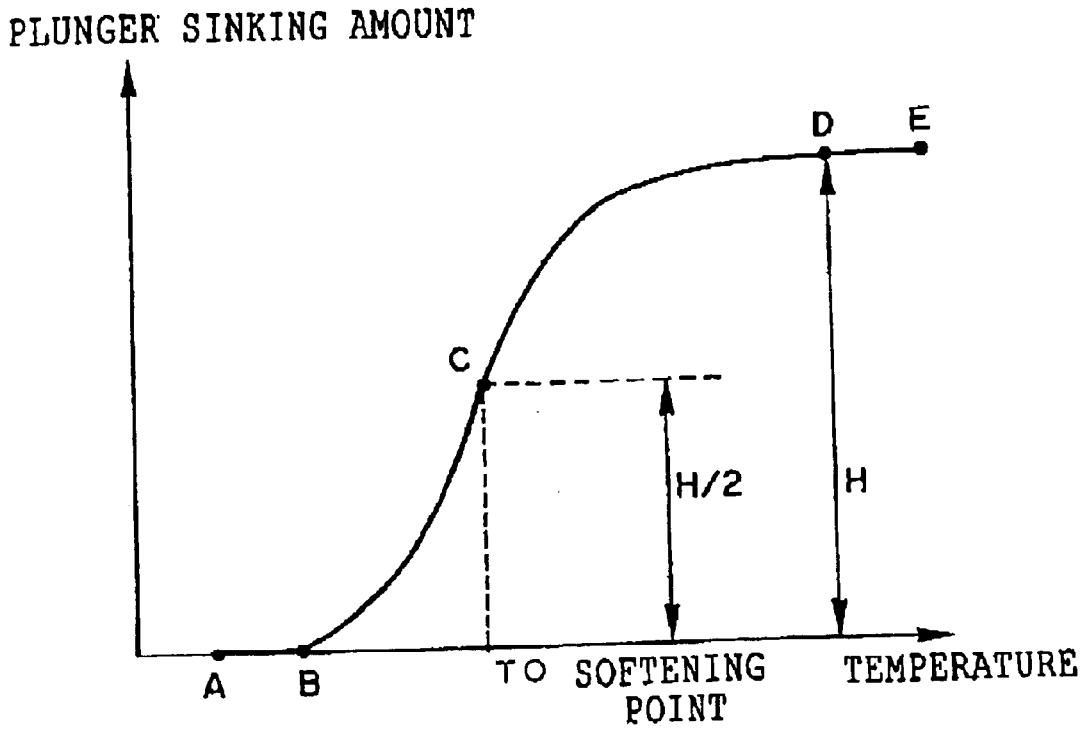
FIG. 2 is a graph showing the relation between an amount at which a resin plunger descends and a temperature curve in measuring a softening point of a resin.

Using a CPT-500A flow tester (manufactured by Shimazu Corp.), an extrusion load of 20 kg is applied to the material to be measured to push the material through a die (nozzle) having a diameter of 0.2 mm and a thickness of 1.0 mm, and after a preheating time of 300 seconds at an initial setting temperature of 70° C., temperature is raised at a constant rate of 6° C./min., to obtain a resin plunger sinking amount-temperature curve (hereinafter, referred to as "softening curve"). As the sample resin, 1 to 3 g of a precisely weighed fine powder is used, and the plunger sectional area is 1.0 $cm^2$. The softening curve has an "S" like shape, as shown in FIG. 2. By heating at the resin particle layer at a constant rate, the resin is gradually heated and begins to flow (plunger lowering: A→B). When heated further, the melted resin flows even more (B→C→D), and plunger lowering stops (D→E). Height H of the softening curve shows the total flow amount, and temperature $T_0$ with respect to point C which becomes H/2 is the softening point of the sample (resin).

There are no particular restrictions on how the resin particle layer is preheated in the preheating step. For example, the resin particle layer can be preheated using a heater, an oven, or electromagnetic induction. Electromagnetic induction is basically preferable, because energy efficiency is high because since only the intermediate transfer medium and resin particle layer are heated and because it is possible to make the apparatus compact.

When electromagnetic induction is used, it is essential that the intermediate transfer medium contains the heat-generating layer as described above. By heating the heat-generating layer in the intermediate transfer medium by electromagnetic induction, the resin particle layer on the surface of the intermediate transfer medium is preheated.

Step of Transferring and Fixing for Step of Fixing

In the present invention, the resin particle layer retaining the ink is transferred from the intermediate transfer medium to a recording medium and fixed to form an image. In the present invention, the resin particle layer is directly fixed on the recording medium to form an image. Hereinafter, description will be given of these respective steps in the present invention and in the present invention.

Step of Transferring and Fixing in the Case of the Present Invention

In the present invention, the resin particle layer retaining the ink is transferred from the intermediate transfer medium to the recording medium and fixed thereto. Though the resin particle layer may be separately transferred and fixed in separate steps, it is preferable to simultaneously transfer and fix the resin particle layer, because the ink is retained in cavities between the resin particles in the resin particle layer, and in some cases electrostatic transfer of the resin particle layer may be difficult.

By simultaneous transfer and fixing is meant a process in which the intermediate transfer medium and recording medium brought together, with the resin particle layer on the surface of the intermediate transfer medium being disposed therebetween, and heat and pressure are applied to the resin particle layer to simultaneously transfer the resin particle layer to the recording medium and fix the resin particle layer to the recording medium.

In this process, ordinarily the intermediate transfer medium and recording medium are inserted between a heating roller and a pressure roller, so that the surface of the intermediate transfer medium on which the resin particle layer is disposed and the recording medium layer come into contact each other, whereby the intermediate transfer medium and the recording medium are nipped between the heating roller and the pressure roller and are pressed together. A pair of pressure members (including two rollers) (generically referred to as "pressure transfer and fixing members") may also be in addition to or in place of the heating roller and the pressure roller, and the resin particle layer can, prior to being finally transferred and fixed by these pressure transfer and fixing members, be preheated between the recording step and the transferring and fixing step. By preheating the resin particle layer, deficiencies in heating time and/or heating amount in finally transferring and fixing the resin particle layer can be compensated for.

There are no particular limitations on how the resin particle layer is heated in this case. For example, the resin particle layer can be heated using a heater, an oven, or electromagnetic induction. Electromagnetic induction is basically preferable, because energy efficiency is high because since only the intermediate transfer medium and resin particle layer are heated and because it is possible to make the apparatus compact. When the resin particle layer is preheated in the preheating step by electromagnetic induction, the heat-generating layer included in the intermediate transfer medium can also be used in this heating step.

When electromagnetic induction is used, it is essential that the intermediate transfer medium contains the heat-generating layer as described above. By heating the heat-generating layer in the intermediate transfer medium by electromagnetic induction, the resin particle layer on the surface of the intermediate transfer medium is preheated.

Heating in the heating step may be conducted at a lower temperature than the temperature at which fixing is conducted during the step of fixing and transferring, because the heating generally serves to aid heating in the subsequent step of transferring and fixing. However, heating for the purpose of fixing the resin particle layer to the recording medium may also be conducted, since it is permissible to sufficiently melt the resin particle in the heating step and to apply only pressure in the transferring and fixing step.

In view of this, in the heating process, the resin particles are heated at a temperature higher than the softening temperature of the resin in the resin particles by preferably 20 to 150° C., more preferably 30 to 100° C., preferably for 0.1 to 10 seconds, more preferably for 0.5 to 3 seconds.

On the other hand, the temperature at which heating for fixing in the simultaneous transferring and fixing is conducted is higher than the softening temperature of the resin in the resin particles by preferably 30 to 150° C., more preferably 50 to 120° C.

In the step of transferring and fixing, it is preferable to cool the resin particle layer between the intermediate transfer medium and the recording medium after heat and pressure have been applied to the resin particle layer, and then to strip the recording medium from the intermediate transfer medium together with the resin particle layer retaining the ink. By doing so, viscosity of the resin particle layer is enhanced and releaseability is improved. Moreover, if image gloss on the surface of the recording medium reflects the surface conditions of the intermediate transfer medium and surface roughness of the intermediate transfer medium is suppressed at a low level, it becomes possible to attain a level of image gloss required for photography and printing. Further, since most of the resin particle layer including the ink image on the surface of the intermediate transfer medium is transferred to and fixed on the recording medium, the burden of cleaning the intermediate transfer medium is reduced or cleaning becomes altogether unnecessary. In order to form a high gloss image, it is preferable for the surface roughness of the intermediate transfer medium to be 1.0 $\mu$m or less, and more preferably in the range of 0.1 $\mu$m to 0.5 $\mu$m in terms or 10 points average roughness (according to JIS B0601).

The resin particle layer may be cooled by, for example, simply allowing the resin particle layer to stand for a sufficient period of time after heat and pressure have been applied thereto and before the recording medium is stripped from the intermediate transfer medium, or by blowing air on the resin particle layer during the same time interval. In the latter case, the time required for cooling the resin particle layer to a given temperature and the total time required for image formation can both be shortened, and it is possible to make the image forming apparatus compact.

At the time the resin particle layer is cooled, it is preferable to strip the recording medium from the intermediate transfer medium after the resin particle layer is cooled to the softening temperature or less of the resin included in the resin particle layer. By stripping the recording medium after the resin particle layer is cooled to the softening temperature or less of the resin included in the resin particle layer, high image gloss and high stripeability can be realized at even higher levels as described above.

When transfer and fixing of the resin particle layer are conducted separately, it is common to transfer the resin particle layer to the recording medium by electric field transfer. However, because ink is retained in the cavities between the resin particles in the resin particle layer, adhesive force between the ink and the surface of the intermediate transfer medium and adhesive force between the resin particles via the ink become problematic. Therefore, in this case, it is preferable to adopt strategies to cope with these problems by, for example, conducting the electric field transfer with an electrostatic force sufficient to overcome these adhesive forces, or by suppressing the amount of ink jetted in the recording step (e.g., to prevent contact between the intermediate transfer medium and the ink) or increasing the thickness of the resin particle layer to suppress these adhesive forces.

When transferring and fixing are conducted separately, fixing is conducted in the same manner as fixing in the case of the present invention described below.

Step of Fixing in the Case of the Second Aspect of Present Invention

In the second aspect of the present invention, the resin particle layer retaining the ink is directly fixed on the surface of the recording medium. There are no particular limitations on how the resin particle layer is fixed to the recording medium. However, it is preferable to use a method, well known in the field of electrophotography, in which beat is applied to the resin particle layer formed on the surface of the recording medium to thereby melt the resin particles, and then pressure is applied to the melted resin particles to fix the resin particle layer to the recording medium.

When this method is employed, the resin particle layer can be fixed to the recording medium by, for example: nipping the recording medium between a heating roller and a pressure roller (two-roller nip); nipping the recording medium between a roller and a belt by using, in place of the heating roller, a heating member to press a belt to a pressure roller or by using, in place of the pressure roller, a pressure member to press a belt to a heating roller (roller/belt nip); nipping the recording medium between surfaces of two opposing belts disposed between a heating member and a press member (belt/belt nip). Although any of a number of means can be adopted in the present invention, it is preferable to use the two-roller nip in view of creating a fixing device with a simple structure.

The heating roller can be one coated with a fluorine-based resin or a silicone-based resin, and can include a coating agent including a filler having high thermal conductivity.

Regarding fixing conditions, the surface temperature of the heating roller is preferably higher than the softening temperature of the resin in the resin particles, and preferably at least 30° C. higher than the softening temperature. By fixing under this condition, an excellent fixed image can be formed.

Image Forming Apparatus of the Present Invention

Next, preferable embodiments of the image forming apparatus of the present invention, to which the method of the present invention is applied, will be described.

First Embodiment

Figure 3:
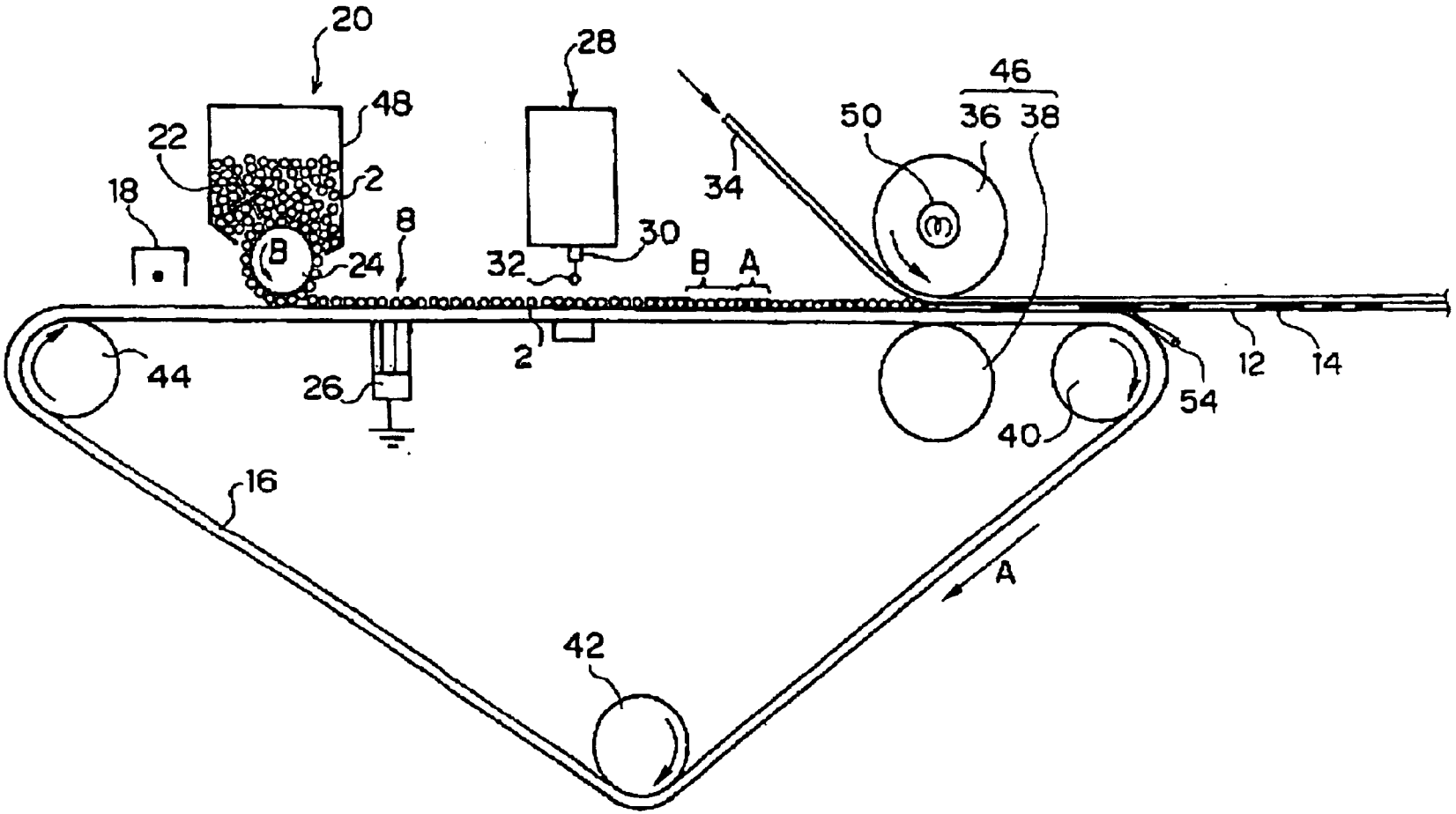
FIG. 3 is a schematic structural view showing a first embodiment of an image forming apparatus according to the present invention.

FIG. 3 is a schematic structural view showing a first embodiment of the image forming apparatus of the present invention. The present embodiment is an embodiment of the present invention described above. In FIG. 3, an intermediate transfer medium 16 in the form of an endless belt is entrained around and held in tension by a driving roller 40 and tensile rollers 42 and 44, and is continuously conveyed by rotation of the driving roller 40 in a direction indicated by arrow A. A charger 18 is disposed upstream in the direction in which the intermediate transfer medium 16 is conveyed. Successively disposed further downstream from the charger 18 are: a developing device (particle layer forming means) 20 for adhering resin particles 2 to a region of the intermediate transfer medium 16 charged by the charger 18, to thereby form a resin particle layer 8; an electrostatic dissipative device 26 for removing electrostatic potential of the intermediate transfer medium 16 and the resin particle layer 8: an inkjet recording device (recording means) 28 for jetting ink 32 from a recording head 30 to the resin particle layer 8, whereby the ink 32 is retained in cavities in the resin particle layer 8 to record an image; and a transfer and fixing device (transferring and fixing means (heating and pressure means)) 46 for disposing a recording medium 34 fed from outside on the intermediate transfer medium 16 and for applying heat and pressure to the resin particle layer 8 to transfer and fix the resin particle layer 8 to the recording medium 34.

The intermediate transfer medium 16 is continuously conveyed, air is ionized by the charger 18 and a positive (or negative) charge is imparted to the surface of the intermediate transfer medium 16, whereby the entire surface of the intermediate transfer medium 16 is given a positive (or negative) charge. Namely, a condition is created in which particles charged with a charge opposite to that of the charger 18 can be electrically absorbed easily. Because the value of the bias potential may be a potential generating a necessary development electric field between the intermediate transfer medium 16 and a development roller 24, the value becomes a function of development bias applied to the development roller 24. In the present invention, it is preferable to for potential of a conductive layer of the intermediate transfer medium 16 to be set at zero volts (i.e., for the conductive layer to be a ground) and for potential to be imparted from an electrical power source so that the development bias becomes a predetermined value. In the present embodiment, the voltage applied to the charger 18 by a method using the charter 18 is controlled to about 6 kV DC.

Next, the resin particles 2 are adhered by the developing device 20 to form the resin particle layer 8 (particle layer forming process).

The developing device 20 includes the development roller 24, which is disposed at a lower part of a container 48 for accommodating the resin particles 2, and a stirring unit 22 disposed in the container 48. The stirring unit 22 stirs the resin particles 2 in the container 48, whereby the resin particles 2 mutually rub against each other and are triboelectrically charged negatively (or positively). Of course, as in two-component development in electrophotographic technology, carriers may be mixed in with the resin particles 2 so that the role of triboelectrically charging the resin particles 2 is borne by the carriers. Regardless of the method used, it is preferable that the resin particles 2 have an insulating property.

The thus-charged resin particles 2 are carried on the development roller 24, and the development roller 24 is rotated by driving means (not shown) in a direction indicated by arrow B to convey the resin particles 2 to a site facing the intermediate transfer medium 16. When carriers are used, a magnetic brush is formed on a surface of the development roller 24 by the carriers, and the resin particles 2 are conveyed by this magnetic brush.

After the resin particles 2 are conveyed to the site facing the intermediate transfer medium 16, the resin particles 2 contact or are brought near the intermediate transfer medium 16 and are transferred by electrostatic force to the entire surface of the intermediate transfer medium 16 charged by the charger 18.

Since an electric field acts between the development roller 24 and the charged intermediate transfer medium 16, electrostatic force acts on the charged resin particles 2, whereby the resin particle layer 8 comprising a porous thin film of the resin particles 2 is formed on the surface of the intermediate transfer medium 16. Transfer of the resin particles 2 may be facilitated by adding a bias electric source to further enhance development efficiency. The amount of resin particles 2 adhering to the surface of the intermediate transfer medium 16 may also be controlled, depending on the amount of ink jetted in recording. When the amount of ink jetted is large, development amount is preferably increased and when the amount of ink jetted is small, development amount is preferably reduced.

The composition of the resin particles 2 used in the present embodiment is exemplified below. However, the present invention is not limited thereto.

(Composition of Resin Particles 2)

| | |
|---|---|
| Polyester resin | 93 parts by weight |
| Polyethylene wax | 3 parts by weight |
| Polypropylene wax | 2 parts by weight |
| Porous silica particles (externally mixed) | 2 parts by weight |

In the above composition, the porous silica particles are inorganic fine particles externally added to further improve ink retentivity. The volume average diameter of the resin particles 2 was 8 $\mu$m.

Next, electrostatic potential of the intermediate transfer medium 16 and the resin particle layer 8 is removed by the electrostatic dissipative device 26. If recording is conducted when the resin particle layer 8 adhering to the intermediate transfer medium 16 retains an electric charge, ink 23 may be undesirably deflected by an electric field. It is thus preferable to remove the electric charge of the intermediate transfer medium 16 and the resin particle layer 8 as in the present embodiment. Known methods for removing electrostatic potential can be used without problem. However, the electrostatic dissipative device 26 is not essential to the present invention.

As the intermediate transfer medium 16 is continuously conveyed, the ink (ink droplets) 32 is discharged from a recording head 30 by the inkjet recording device 28 using an electrical driving means (not shown), to record a desired image on the resin particle layer 8 disposed on the surface of the intermediate transfer medium 16. The resin particle layer 8 includes cavities sufficient for retaining a large amount of ink at high speed. As shown in FIG. 3, cavities remain unaffected at non-image parts B, while cavities at image parts A retain the ink 32 image-wise.

Figure 4:
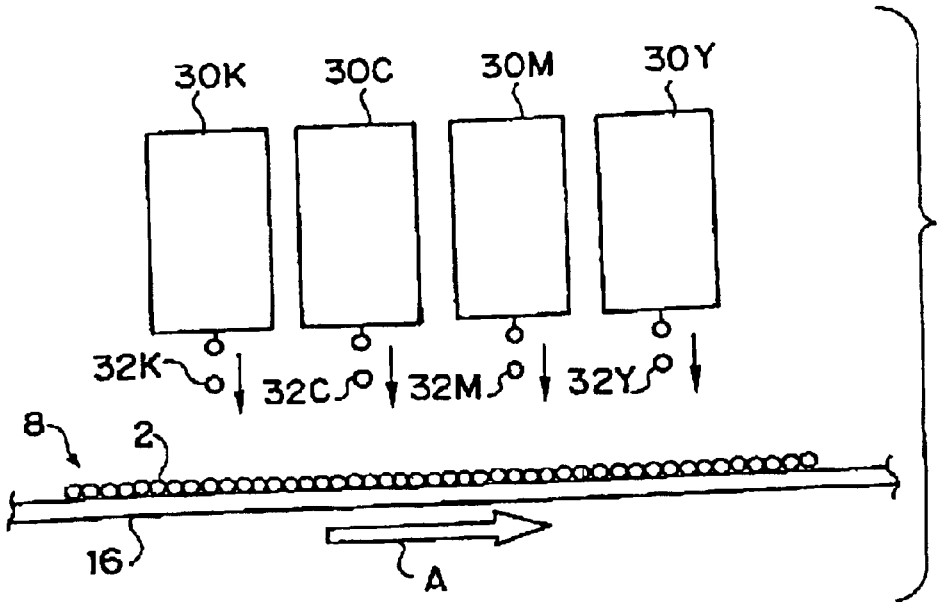
FIG. 4 is an enlarged schematic view showing the circumference of a recording head in the image forming apparatus of FIG. 3.

Although only one recording head 30 is shown in FIG. 3, the inkjet recording device 28 of the present embodiment actually includes, as shown in FIG. 4, recording heads 30K, 30C, 30M and 30Y for the four colors black (K), cyan (C), magenta (M) and yellow (Y) to form full color images. Each recording head includes a multi-nozzle having a plurality of inkjet nozzles.

As shown in FIG. 4, printing signals are sent to the recording heads 30K, 30C, 30M and 30Y based on image signals, and inks (ink droplets) 30K (black), 30C (cyan), 30K (magenta) and 30Y (yellow) are successively jetted from the recording heads to form an image on the resin particle layer 8. The printing signals are controlled so as not overlap to on the same pixel, and color images are formed by complete color mixing. Therefore, there may also be cases where inks of a maximum of four colors are jetted onto one pixel.

In the present embodiment, the recording heads 30K, 30C, 30M and 30Y each had 3200 nozzles, a resolution of 400 DPI (Vd=30 ng/dot), a maximum ink jetting amount v of 22 $\mu g/mm^2$, and a recording speed of 4 KHz. Even if a large amount of ink is used in the present embodiment, cavities between the resin particles 2 firmly retain the ink 32. Thus, even when plain paper is used as the recording medium 34, as in the present embodiment, color images of high image quality are obtainable regardless of the material of the recording medium 34, because there is no bleeding due to ink leakage.

The composition of each color ink used in the present embodiment is exemplified below. However, the present invention is not limited thereto.

| | |
|---|---|
| (Yellow Ink 32Y) | |
| C. I. Direct Yellow-86 (dye) | 2 parts by weight |
| Thiodiglycol (water-soluble organic solvent) | 10 parts by weight |
| Acetylenol (additive) | 0.05 parts by weight |
| Water | remaining amount |
| total | 100 parts by weight |
| (Magenta Ink 32M) | |
| C. I. Acid Red-289 (dye) | 2.5 parts by weight |
| Thiodiglycol | 10 parts by weight |
| Acetylenol | 0.05 parts by weight |
| Water | remaining amount |
| total | 100 parts by weight |
| (Cyan Ink 32C) | |
| C. I. Acid Blue-9 (dye) | 2.5 parts by weight |
| Thiodiglycol | 10 parts by weight |
| Acetylenol | 0.05 parts by weight |
| Water | remaining amount |
| total | 100 parts by weight |
| (Black Ink 32K) | |
| C. I. Food Black-2 (dye) | 3 parts by weight |
| Thiodiglycol | 10 parts by weight |
| Acetylenol | 0.05 parts by weight |
| Water | remaining amount |
| total | 100 parts by weight |

Finally, the transfer and fixing device 46 disposes the recording medium 34 on the intermediate transfer medium 16 and applies heat and pressure to the resin particle layer 8, whereby the resin particle layer 8 is, together with the image, transferred to and fixed on the recording medium 34.

The transfer and fixing device 46 includes a heating roller 36, having disposed therein a heater 50 as a heating source, and a pressure roller 38, with the heating roller 36 and the pressure roller 38 forming a nip.

In the present embodiment, both the heating roller 36 and the pressure roller 38 were prepared by coating silicone rubber at a thickness of 2.0 mm on the outer surface of an aluminum core having a diameter of 28 mm, and further disposing on the coated core a PFA tube having a thickness of 30 $\mu$m. Additionally, the width of the nip formed between the heating roller 36 and the pressure roller 38 is about 5 mm, the heater 50 is a halogen lamp, and the temperature of the surface of the heating roller 36 is regulated by a temperature sensor (not shown) to be about 160° C.

When the recording medium 34 and the intermediate transfer medium 16 are inserted between and nipped by the heating roller 36 and the pressure roller 38 (with the resin particle layer 8 being disposed between the recording medium 34 and the intermediate transfer medium 16), the heating roller 36 contacts and quickly heats the resin particle layer 8 while pressure is applied to the resin particle layer 8. The heating roller 36 and the pressure roller 38 apply pressure to the resin particle 8 to deform the same, whereby the resin particle layer 8 is simultaneously transferred to and fixed on recording medium 34. In the present embodiment, since the surface of the heating roller 36 has high smoothness (Rz=0.3 $\mu$m), flatness is preserved and a glossy, transparent color image is formed by the resin particles 2 of the resin particle layer 8 being deformed under pressure by the surface of the heating roller 36.

The ink 32 between the resin particles 2 in the resin particle layer 8 is retained in the melted resin particles 2, and transferred to and fixed on the recording medium 34 together with the resin particles 2.

When inkjet recording of the image is completed, the resin particle layer 8 retaining the ink 32 is transferred to and fixed firmly on the recording medium 34, and color reproducibility, which is the life of a color image, by color mixing is manifested.

A tooth (stripping means) 54 is disposed at a position 50 mm downstream from an outlet of the nip formed by the heating roller 36 and the pressure roller 38. The tooth 54 strips the recording medium 34 from the intermediate transfer medium 16, and the recording medium 34 is then discharged into a tray (not shown).

Image formation according to the present embodiment is completed through the above-described steps. Apparatus conditions, such as fixing temperature, may be respectively optimized since they are determined in accordance with factors such as the compositions of the resin particles 2 and the ink 32 and the amount of the ink 32 jetted.

According to the present embodiment, because the ink 32 is effectively retained in cavities between the resin particles 2, drying of the ink 32 is accelerated and problems such as bleeding and stains do not occur even when color images are printed. Moreover, jetted ink droplets (the ink 32) do not rebound, whereby problems do not occur at the recording head 30. Therefore, various measures for improving image quality become possible.

Because the resin particle layer 8 retaining the ink 32 is transferred to the recording medium 34, an image can be formed on all kinds of recording media without being affected by water absorption and drying properties of the surface of the recording medium 34. Further, when the resin particle layer 8 is formed as a result of the resin particles 2 being melted and hardened by fixing, an image formed by the ink 32 is incorporated into the resin particle layer 8, and an image having not only excellent resistance to water and light, which was insufficient in images formed solely with dye ink, but excellent resistance to ozone as well can be formed.

Second Embodiment

Figure 5:
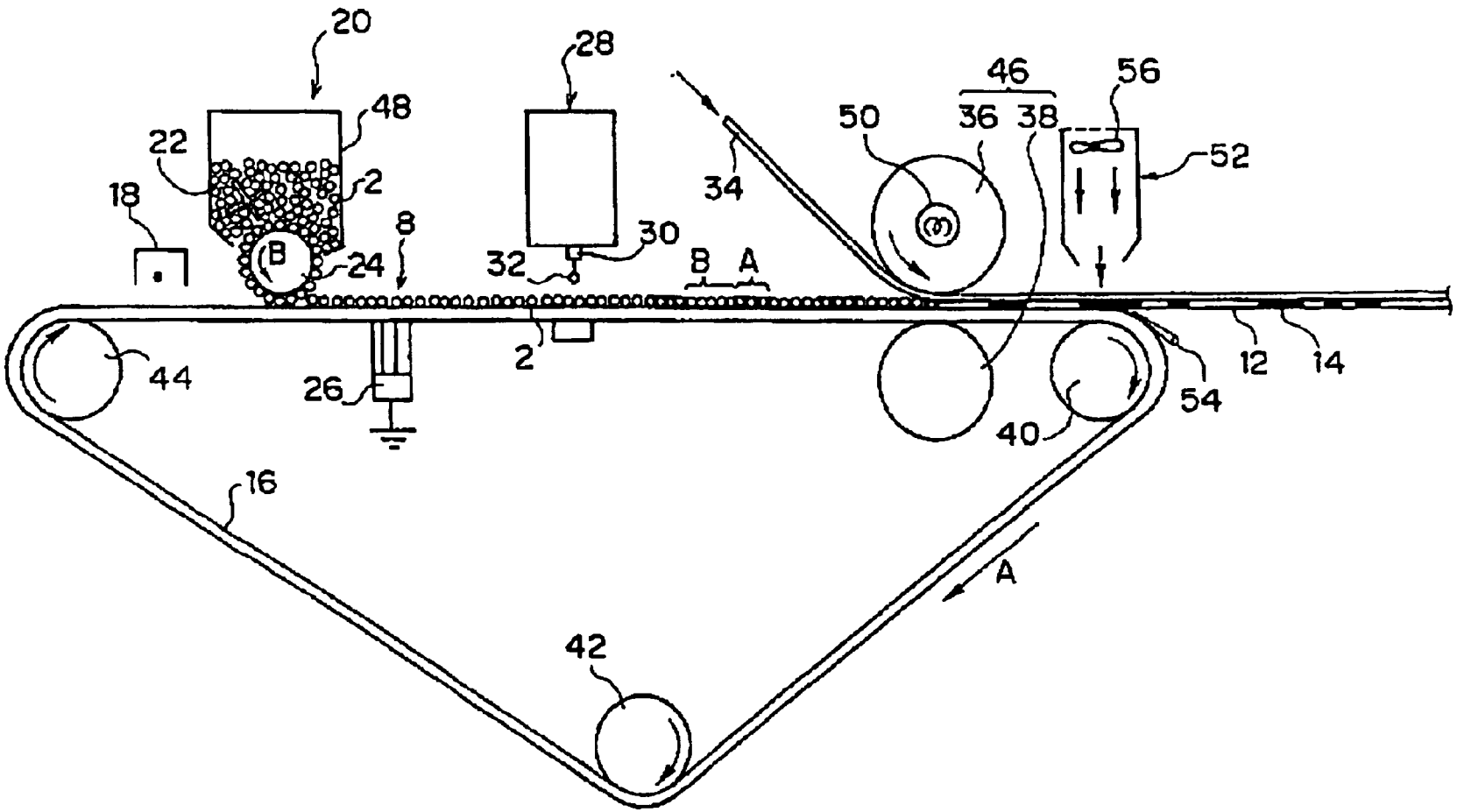
FIG. 5 is a schematic structural view showing a second embodiment of the image forming apparatus of the present invention.

FIG. 5 is a schematic structural view showing a second embodiment of the image forming apparatus of the present invention. The present embodiment is also an embodiment of the present invention. The image forming apparatus of the present embodiment is different from the image forming apparatus of the first embodiment in that a cooling device 52 is disposed at downstream from the transfer and fixing device (heating and pressure means) 46. Members having functions the same as members in the first embodiment are indicated by the same reference numerals, and detailed description thereof is omitted.

In the present embodiment, cooling is conducted by the cooling device 52 following transfer and fixing of the resin particle layer 8 by the transfer and fixing device 46, using the intermediate transfer medium 16 having a high gloss surface. The cooling device 52 includes a fan 56 for blowing cooling wind towards the layered product formed by the recording medium 34 and the intermediate transfer medium 16 (with the resin particle layer 8 being interposed therebetween). After the temperature of the sandwiched resin particle layer 8 is lowered to the softening temperature or less of the resin in the resin particles 2, the recording medium 34 is stripped from the intermediate transfer medium 16 by the tooth 54.

Thus, when cooling is conducted, the gloss of images 12 and 14 formed on the surface of the recording medium 34 has the same high level as the surface condition of the intermediate transfer medium 16, and the same image gloss level required for photography and printing can be achieved. Moreover, since most of the resin particle layer 8 containing ink images on the surface of the intermediate transfer medium 16 is transferred to and fixed on the recording medium 34, the burden of cleaning the intermediate transfer medium 16 is reduced, or cleaning becomes altogether unnecessary.

Because components other than the cooling device 52 are the same as those in the first embodiment, the image forming apparatus of the present embodiment has also the same action and effects of the image forming apparatus of the first embodiment.

Third Embodiment

Figure 6:
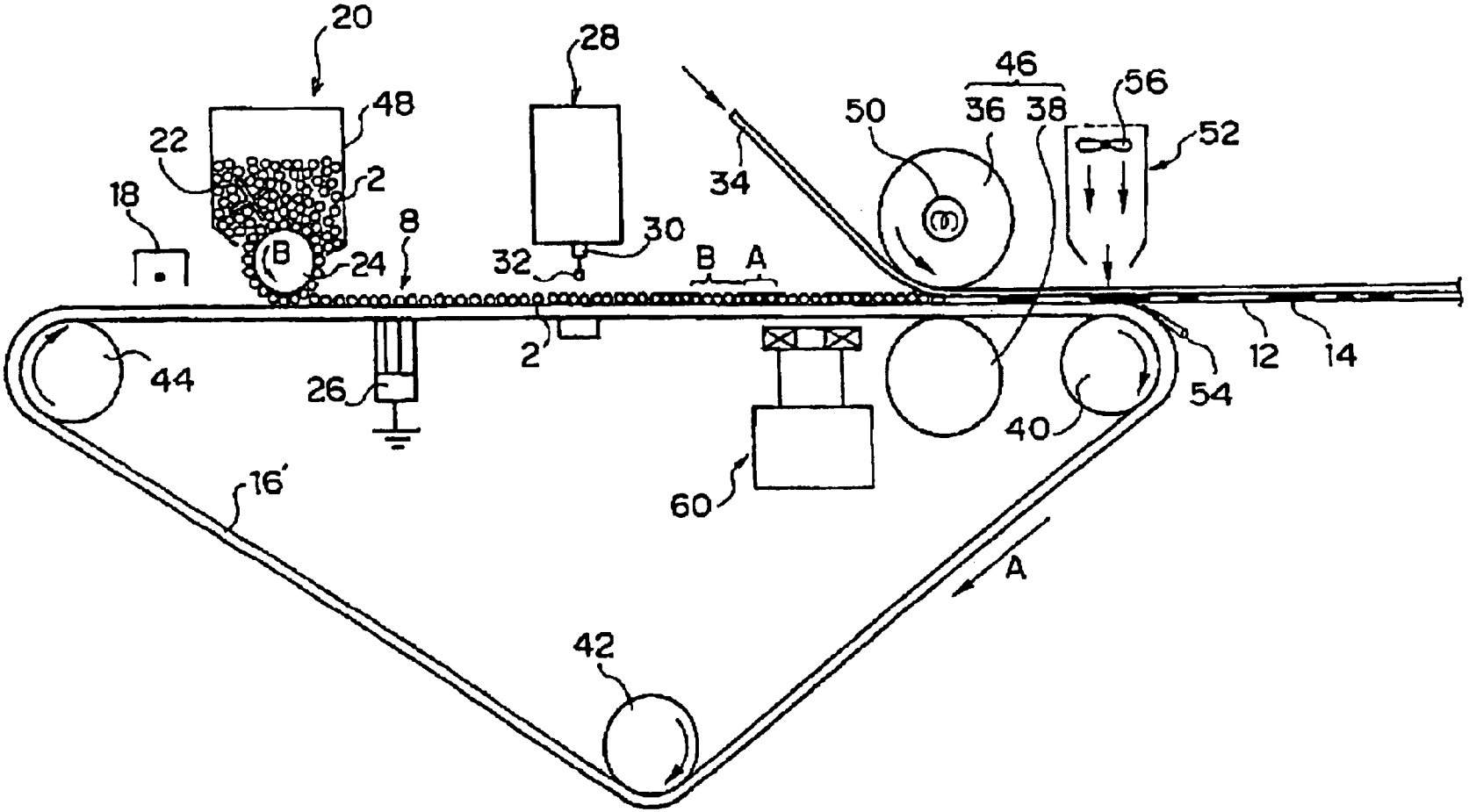
FIG. 6 is a schematic structural view showing a third embodiment of the image forming apparatus of the present invention.

FIG. 6 is a schematic structural view showing a third embodiment of the image forming apparatus of the present invention. The present embodiment is an embodiment of the present invention. The image forming apparatus of the present embodiment is different from the image forming apparatus of the second embodiment in that the intermediate transfer medium 16 is replaced by an intermediate transfer medium 16' including a heat-generating layer, and in that an electromagnetic induction heating device (heating means) 60 is provided downstream from the inkjet recording device (recording means) 28 and upstream from the transfer and fixing device (transfer and fixation means) 46. Members having functions the same as members in the first or second embodiments are indicated by the same reference numerals, and detailed description thereof is omitted.

In the present embodiment, heating is conducted between recording and the transferring and fixing, and electromagnetic induction heating is used. In electromagnetic induction heating, a magnetic field generated by generating means (e.g., by combining a magnetic core with a coil) is changed by an excitation circuit, to generate an eddy current in a heat-generating layer near the surface of an intermediate transfer medium as a conductive member (inductive magnetic material, magnetic field-keeping electric material) moving in the magnetic field. The eddy current is converted into heat (joule heat) by electrical resistance in the heat-generating layer, so that only places near the surface of the intermediate transfer medium generate heat. Therefore, this heating method has remarkably excellent thermal efficiency.

When the varying magnetic field crosses a conductive body, an eddy current is generated in an electromagnetic induction heat-generating layer in an intermediate transfer medium to generate a magnetic field which prevents the magnetic field from changing. The eddy current causes the electromagnetic induction heat-generating layer to generate heat due to the skin resistance of a heat-generating layer in the intermediate transfer medium, at a power in proportion to the skin resistance. Thus, since places near the surface of the intermediate transfer medium generate heat directly without contact, there is the advantage that quick heating is possible irrespective of the heat conductivity and heat capacity of the base layer of the intermediate transfer medium. Further, quick heating can be realized without dependency on the thickness of the intermediate transfer medium.

Figure 7:
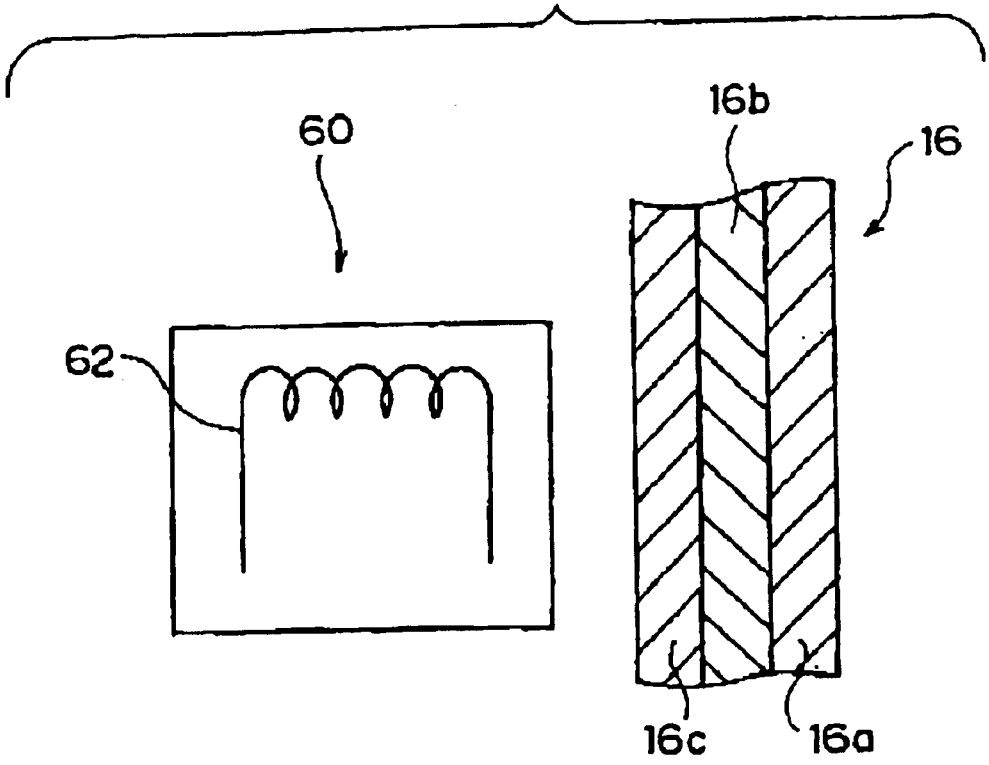
FIG. 7 is a schematic view for explaining the principle of electromagnetic induction heating.

FIG. 7 is a schematic illustration view for explaining the principle of electromagnetic induction heating. In FIG. 7, 16 represents the section of a part of an intermediate transfer medium.

The intermediate transfer medium 16 comprises a base material (base layer) 16*a* including a surface having disposed thereon a heat-generating layer 16*b*, which is a conductive member that self-generates heat by electromagnetic induction action, with a releasing layer 16*c* having excellent releaseability with the resin particles 2 being disposed on the heat-generating layer 16*b*. In the electromagnetic induction heating device 60, an alternating current is applied to an excitation coil 62 by an excitation circuit (not shown) to form an alternating magnetic field roughly perpendicular to the surface of the intermediate transfer medium 16.

The principle by which heat is generated in the heat-generating layer 16*b* due to electromagnetic induction action will be described below.

When the alternating current is applied to the excitation coil 62 by the excitation circuit, a magnetic flux repeatedly appears and disappears around the excitation coil 62. When the magnetic flux crosses the heat-generating layer 16*b* of the intermediate transfer medium 16, the eddy current is generated in the heat-generating layer 16*b* to thereby generate the magnetic field which prevents change of the magnetic flux. Joule heat is generated by this eddy current and the resistivity of the heat-generating layer 16*b*.

The eddy current flows primarily towards the surface of the heat-generating layer 16*b* nearest the X electromagnetic induction heating device 60 due to skin effect, and generates heat at a power in proportion to the skin resistance Rs of the heat-generating layer 16*b*. Here, when angular frequency is represented by $\omega$, magnetic permeability is represented by $\mu$, and resistivity is represented by $\rho$, the skin depth $\delta$ is represented by the following formula.

$$\delta=(2\rho/\omega\mu)^{1/2}$$

Skin resistance RS is represented by the following formula.

$$Rs=\rho/\delta=(\omega\mu\rho/2)^{1/2}$$

Power P generated in the heat-generating layer 16*b* in the intermediate transfer medium 16 is represented by the following formula when current flowing in the intermediate transfer medium 16 is represented by Ih.

$$P\propto Rs\int|Ih|2dS$$

Therefore, when the skin resistance Rs is increased or the current Ih is increased, the power P is increased and amount of heat generated is increased. Here, the skin depth $\delta$ (m) is represented by the following formula using frequency of an excitation circuit f (Hz), relative magnetic permeability $\mu r$ and resistivity $\rho(\Omega m)$.

$$\delta=503\ (\rho/(f\mu r))^{1/2}$$

This indicates the depth of absorption of the electromagnetic wave used in electromagnetic induction. When the depth is deeper-than this, the strength of the electromagnetic wave becomes 1/e or less. i.e., most energy is absorbed towards this depth.

It is preferable that the thickness of the heat-generating layer 16*b* is larger (1 to 100 $\mu$m) than the skin depth represented by the above formula. When the thickness of the heat-generating layer 16*b* is smaller than 1 $\mu$m, most of the electromagnetic energy cannot be absorbed, whereby efficiency becomes poor.

As described above, the heat-generating layer 16*b* in the intermediate transfer medium 16 generates heat by electromagnetic induction heating due to the application of the alternate current from the excitation circuit to the excitation coil 62. The resin particles 2 on the surface of the intermediate transfer medium 16 are melted by the heat generated. When the recording medium 34 and the intermediate transfer medium 16 are nipped between the heating roller 36 and the pressure roller 38 of the transfer and fixing device 46, with the resin particle layer 8 between interposed between the recording medium 34 and the intermediate transfer medium 16, the heating roller 36, whose surface is heated by the heater 50, comes into contact with and quickly heats the resin particle layer 8, and pressure is applied by the heating roller 36 and the pressure roller 38 to cause deformation so that the resin particle layer 8 is transferred to and simultaneously fixed on the recording medium 34.

According to the present embodiment, by preheating the resin particle layer 8 on the surface of the intermediate transfer medium 16, deficiencies in heating time and/or heating amount in the subsequent final transfer and fixing can be compensated for. Further, when all of the heat energy necessary for transferring and fixing is imparted by the electromagnetic induction heating device 60, it becomes unnecessary to dispose a heat source such as the heater 50 in the heating roller 36.

Because components other than the electromagnetic induction heating device 60 are the same as those in the second embodiment, the image forming apparatus of the present embodiment has also the same action and effects of the image forming apparatus of the first and second embodiments.

Fourth Embodiment

Figure 8:
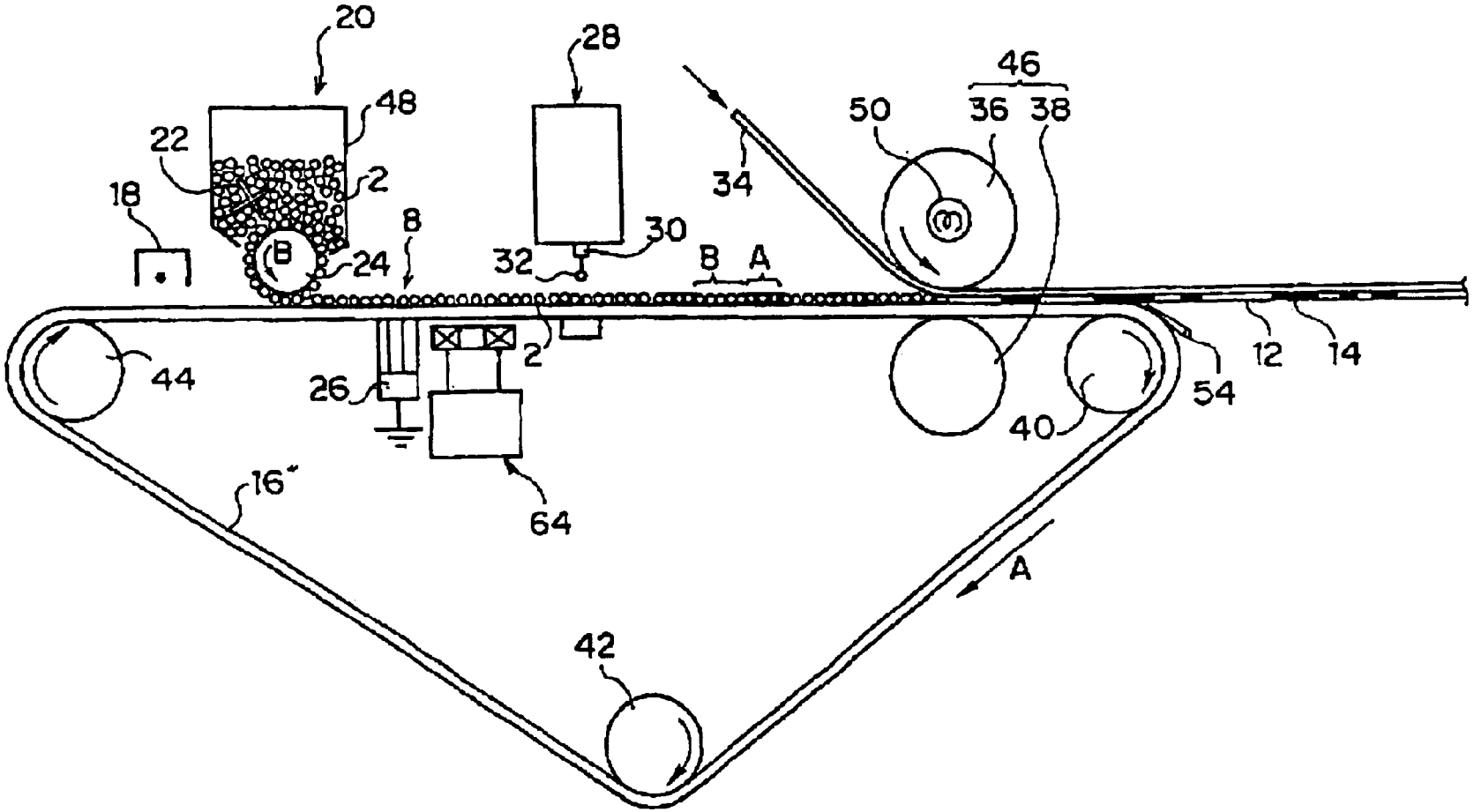
FIG. 8 is a schematic structural view showing a fourth embodiment of the image forming apparatus of the present invention.

FIG. 8 is a schematic structural view showing a fourth embodiment of the image forming apparatus of the present invention. The present embodiment is an embodiment of the present invention. The image forming apparatus of the present embodiment is different from the image forming apparatus of the first embodiment in that the intermediate transfer medium 16 is replaced by an intermediate transfer medium 16" including a heat-generating layer, and an electromagnetic induction heating device (preheating means) 64 is disposed downstream from the developing device 20 and upstream from the inkjet recording device 28. Members having functions the same as members in the first embodiment are indicated by the same reference numerals, and detailed description thereof is omitted.

The principle and structure of the electromagnetic induction heating device 64 are the same as those described in relation to the electromagnetic induction heating device 60 in the third embodiment. However, in the present embodiment, the electromagnetic induction heating device 64 is placed upstream from the inkjet recording device 28.

The resin particle layer 8 formed by the developing device 20 includes cavities between the resin particles 2 that are connected continuously. However, in the present embodiment, by preheating the resin particle layer 8 with the electromagnetic induction heating device 64, the resin particles 2 in the resin particle layer 8 are slightly melted to partially seal cavities between the resin particles 2 to form independent cavities. Thus, bleeding of the ink 32 can be prevented.

Because components other than the electromagnetic induction heating device 60 are the same as those in the second embodiment, the image forming apparatus of the present embodiment has also the same action and effects of the image forming apparatus of the first and second embodiments.

Fifth Embodiment

Figure 9:
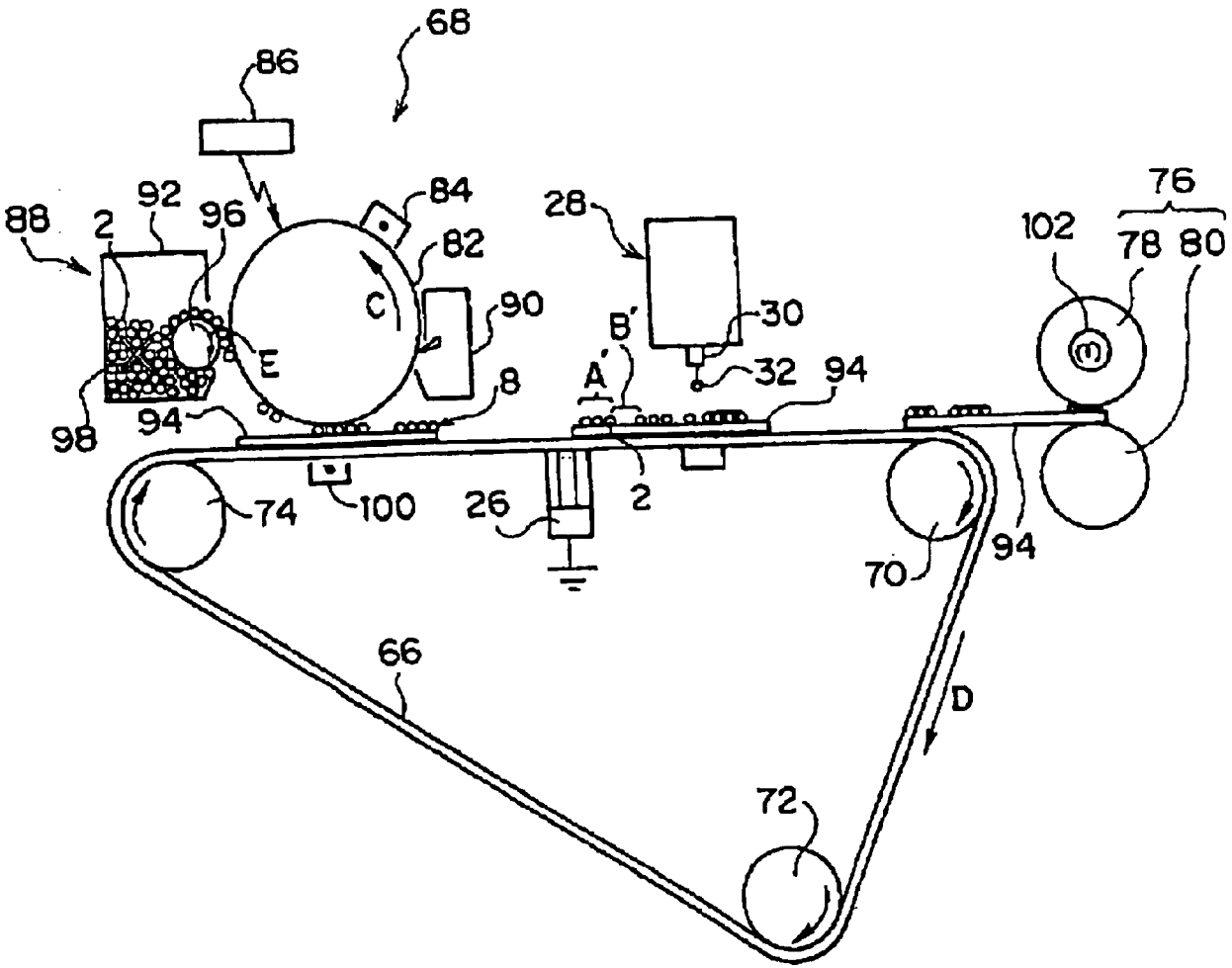
FIG. 9 is a schematic structural view showing a fifth embodiment of the image forming apparatus of the present invention.

FIG. 9 is a schematic structural view showing a fifth embodiment of an image forming apparatus of the present invention. The present embodiment is a preferable embodiment of the present invention. In FIG. 9, an endless conveyor belt 66 is entrained around and held in tension by a driving roller 70 and tensile rollers 72 and 74, and is continuously conveyed by rotation of the driving roller 70 in a direction indicated by arrow D to convey a recording medium 94 fed from outside. A device (particle layer forming means) 68 for forming a resin particle layer 8 made of resin particles 2 on the surface of a recording medium 94 is disposed upstream in the conveyance direction. Successively disposed further downstream from the particle layer forming device 68 are: an electrostatic dissipative device 26 for removing electrostatic potential of the recording medium 94 and the resin particle layer 8; an inkjet recording device (recording means) 28 for jetting ink 32 from a recording head 30 to the resin particle layer 8, whereby the ink 32 is retained in cavities in the resin particle layer 8 to record an image: and a fixing device (fixing means) 76 for applying heat and pressure to the recording medium 94 to fix the resin particle layer 8 thereto.

The recording medium 94 is conveyed by the conveyor belt 66, and the particle layer forming device 68 deposits the resin particles 2 on a surface of the recording medium 94 to thereby form the resin particle layer 8 on the recording medium 94.

In the present embodiment, a method using a photosensitive body and known in the field of electrophotography is applied to the particle layer forming device 68. Specifically, the particle layer forming device 68 includes: a photosensitive body 82, which rotates in a direction indicated by arrow C; a charger (charging means) 84 for charging the surface of the photosensitive body 82; an exposure device (exposure means) 86 for exposing a site on a surface of the photosensitive body 82; a developing device (adhesion means) 88 for adhering the triboelectrically charged resin particles 2 to the exposed site on the surface of the photosensitive body 82; a transfer device (adhered particle transferring means) 100 for transferring, under an electric field, the resin particles 2 adhering to the surface of the photosensitive body 82 to the surface of the recording medium 94, to thereby form the resin particle layer 8; and a cleaning apparatus 90 for removing resin particles 2 remaining on the surface of the photosensitive body 82. The charger 84, exposure device 86, developing device 88, transfer device 100 and cleaning device 90 are successively disposed around the rotating photosensitive body 82 in the direction of arrow C.

After the photosensitive body 82 is uniformly charged by the charger 84, the surface of the photosensitive body 82 is exposed by the exposure device 86. Exposure by the exposure device 86 is controlled by controlling means (not shown) on the basis of image signals so that the exposed sites on the surface of the photosensitive body 82 correspond to image parts or peripheries thereof. Namely, exposure is controlled so that the resin particle layer 8 is formed only on parts and peripheries thereof (image part A') of the recording medium 94 utilized for printing in when recording is conducted by the inkjet recording device 28.

The photosensitive body 82, on which a latent image is formed by the exposure device 86, rotates as it is in the direction of arrow C, and the triboelectrically charged resin particles 2 are adhered to the photosensitive body by the developing device 88. Adhesion is conducted by developing the latent image formed on the surface of the photosensitive body 82 in the same manner that development is conducted in electrophotographic technology.

The developing device 88 includes a development roller 96 disposed at a position facing the photosensitive body 82, a container 92 for accommodating the resin particles 2, and a stirring unit 98 disposed in the container 92. The stirring unit 98 stirs the resin particles 2 in the container 92, whereby the resin particles 2 mutually rub against each other and are triboelectrically charged negatively (or positively). Of course, as in two-component development in electrophotographic technology, carriers may be mixed in with the resin particles 2 so that the role of triboelectrically charging the resin particles 2 is borne by the carriers. Regardless of the method used, it is preferable that the resin particles 2 have an insulation property.

The thus-charged charged resin particles 2 are carried on the development roller 96, and the development roller 96 is rotated by driving means (not shown) in a direction indicated by arrow E to convey the resin particles 2 to a site facing the photosensitive body 82. When carriers are used, a magnetic brush is formed on the surface of the development roller 96 by the carriers, and the resin particles 2 is conveyed by this magnetic brush.

After the resin particles 2 are conveyed to the site facing the photosensitive body 82, the resin particles contact or are brought near the photosensitive body 82 and are transferred by electrostatic force to the entire surface of the photosensitive body 82 having the latent image formed thereon.

Since an electric field acts between the development roller 96 and the photosensitive body 82 charged, electrostatic force acts on the charged resin particles 2, whereby the resin particle layer 8 comprising a porous thin film made of the resin particles 2 is formed on the exposed site on the surface of the photosensitive body 82. Transfer of-the resin particles 2 may be facilitated by adding a bias electric source to further enhance development efficiency. The amount of resin particles 2 adhering to the surface of the photosensitive body 82 may also be controlled, depending on the amount of ink jetted in inkjet recording. When the amount of ink jetted is large, development amount is preferably increased, and when the amount of ink jetted is small, development amount is preferably reduced.

The photosensitive body 82 carrying on the surface thereof the resin particle layer 8 rotates as it is in the direction of arrow C, and when the resin particle layer 8 reaches the position facing the recording medium 94, the resin particle layer 8 is transferred under electric field to the surface of the recording medium 94 by the transfer device 100. The transfer device 100 is disposed at a position opposite to the photosensitive body 82 via the recording medium 94 and the conveyor belt 66, and attracts the resin particle layer 8 on the surface of the photosensitive body 82 by electrostatic attractive force and to cause the resin particle layer 8 to be transferred to the surface of the recording medium 94. Any transfer device known in the field of electrophotography can be used without problem for the transfer device 100. In the present embodiment, plain paper is used as the recording medium 34. The photosensitive body 82 further rotates in the direction of arrow C, and resin particles 2 remaining on the surface are removed by the cleaning device 90.

The resin particle layer 8 is thus formed on the surface of the recording medium 94 at image parts or peripheral parts thereof A' in inkjet recording on the basis of image signals, and the resin particle layer 8 is not formed at most of non-image parts B'. Therefore, according to the image forming apparatus of the present embodiment, the amount of the resin particles 2 used can be reduced, which is not only cost-effective but reduces the capacity of the container 92, whereby it becomes possible to make the apparatus compact.

Next, electrostatic potential of the recording medium 94 and the resin particle layer 8 is removed by the electrostatic dissipative device 26. The function, action and effects of the electrostatic dissipative device 26 are the same as those of the electrostatic dissipative device in the first embodiment, and description thereof is omitted.

As the recording medium 94 is continuously conveyed, ink (ink droplets) 32 is discharged from the recording head 30 by the inkjet recording device 28 using an electrical driving means (not shown), to record a desired image on the resin particle layer 8 disposed on the surface of the recording medium 94. In the present embodiment, in recording by the inkjet recording device 28, the resin particle layer 8 is formed only on image parts or peripheral parts thereof A'. The function, action and effects of the inkjet recording device 28 are the same as those of the inkjet recording device in the first embodiment, and description thereof is omitted.

Thereafter, the recording medium 94 is further continuously conveyed and fed to the fixing device 76 along a conveyance guide (not shown) from the conveyor belt 66, whereby the fixing guide applies heat and pressure to the resin particle layer a to transfer the resin particle layer 8 to the recording medium 94 and fix an image on the recording medium.

The fixing device 76 includes a heating roller 78 having disposed therein a heater 102 as a heating source, and a pressure roller 80, with the heating roller 78 and the pressure roller 80 forming a nip. The temperature of the surface of the heating roller 78 is controlled by the heater 102 and a temperature sensor (not shown) to be about 160° C.

When the recording medium 94 is inserted between and nipped by the heating roller 78 and the pressure roller 80, the heating roller 78 contacts the resin particle layer 8, whereby pressure and heat are applied to the resin particle layer 8, the resin particles 2 are melted and fixed, and an image of the ink 32 retained in cavities between the resin particles 2 is fixed to the recording medium 94.

After the recording medium 94 has passed through nip formed by the heating roller 76 and the pressure roller 80, the recording medium 94 is discharged into a tray (not shown).

Image formation according to the present embodiment is completed through the above-described steps. Apparatus conditions, such as fixing temperature, may be respectively optimized since they are determined in accordance with factors such as the compositions of the resin particles 2 and the ink 32 and the amount of the ink 32 jetted.

According to the present embodiment, because the ink 32 is effectively retained in cavities between the resin particles 2, drying of the ink 32 is accelerated and problems such as bleeding and stains do not occur even when color images are printed. Moreover, jetted ink droplets (the ink 32) do not rebound, whereby problems do not occur at the recording head 30. Therefore, various measures for improving image quality become possible.

Because the resin particle layer 8 is formed on the surface of the recording medium 94 before images of the ink 32 are formed, the surface condition of the recording medium 94 can be controlled to be suitable for inkjet recording. Therefore, an image can be formed on all kinds of recording media without being affected by water absorption and drying properties of the surface of the recording medium 94. Further, when the resin particle layer 8 is formed as a result of the resin particles 2 being melted and hardened by fixing, an image formed by the ink 32 is incorporated into the resin particle layer 8, and an image having not only excellent resistance to water and light, which was insufficient in images formed solely with dye ink, but excellent resistance to ozone as well can be formed.

According to the present embodiment, the amount of resin particles used can be reduced and the apparatus can be made compact because the resin particle layer 8 is formed only on image parts or peripheral parts thereof A'.

Though the image forming apparatus of the present invention has been illustrated by way of preferable embodiments, the scope of the present invention is not limited to the same, and persons skilled in the art can appropriately change respective constituent components in accordance with common knowledge. Further, structures described in the embodiments can be mutually replaced and added. For example, the charger 18 and the developing device 20 of the first to fourth embodiments can be replaced by the particle layer forming device 68 of the fifth embodiment, and the resin particle layer 8 can be formed only on image parts or peripheral parts thereof.

As described above, according to the present invention, a method and an apparatus for forming on a recording medium, such as plain paper, an image whose resistance to water and light is improved and whose image quality is enhanced, with printing speed being increased due to drying of ink being accelerated, can be provided. According to the method and apparatus of the present invention, an image having high image quality can be formed on all recording media, irrespective of the surface condition of the recording medium used.

What is claimed is:

1. A method for forming an image comprising at least the steps of:

forming a layer including resin particles on a surface of an intermediate transfer medium;

recording the image by jetting ink from an inkjet recording head onto the resin particle layer so that the ink is retained in cavities of the resin particle layer; and transferring the resin particle layer retaining the ink to a recording medium to fix the resin particle layer thereto.

2. The method of claim 1, wherein the step of transferring and fixing includes:

superposing the intermediate transfer medium on the recording medium, with the resin particle layer on the surface of the intermediate transfer medium disposed therebetween; and heating and applying pressure to the resin particle layer to simultaneously transfer and fix the resin particle layer to the recording medium.

3. The method of claim 2, wherein heating the resin particle layer is conducted between the step of recording and the step of transferring and fixing.

4. The method of claim 3, wherein the intermediate transfer medium includes a heat-generating layer, and the resin particle layer on the surface of the intermediate transfer medium is heated by heating the heat-generating layer by electromagnetic induction.

5. The method of claim 2, wherein, in the step of transferring and fixing, the resin particle layer between the intermediate transfer medium and the recording medium is cooled after heat and pressure have been applied to the resin particle layer, and thereafter the recording medium is stripped from the intermediate transfer medium together with the resin particle layer retaining the ink.

6. The method of claim 5, wherein the recording medium is stripped from the intermediate transfer medium after the resin particle layer is cooled to a softening temperature or lower of the resin included in the resin particle layer.

7. The method of claim 1, wherein the resin particles are chargeable, and the step of forming the resin particle layer includes triboelectrically charging the resin particles to form the resin particle layer on the surface of the intermediate transfer medium by transfer electric field transfer.

8. The method of claim 7, wherein the step of forming the resin particle layer at least includes:

charging a surface of a photosensitive body;

exposing the surface of the photosensitive body;

adhering the triboelectrically charged resin particles to the exposed region of the surface of the photosensitive body; and transferring the resin particles adhering to the surface of the photosensitive body to the surface of the intermediate transfer medium by electric field transfer.

9. The method of claim 8, wherein exposure of the surface of the photosensitive body is conducted on the basis of image signals so that the exposed region corresponds to an image part or periphery thereof.

10. The method of claim 1, wherein at least one of inorganic fine particles and organic fine particles are added to the resin particles by at least one of internal addition and external addition.

11. The method of claim 1, wherein the resin particle layer is preheated between the step of forming the resin particle layer and the step of recording.

12. The method of claim 11, wherein the intermediate transfer medium includes a heat-generating layer, and the resin particle layer on the surface of the intermediate transfer medium is preheated by heating the heat-generating layer by electromagnetic induction.

13. The method of claim 1, wherein the resin particles include a foaming agent.

14. The method of claim 13, wherein the foaming agent comprises microcapsule particles including a substance having a low boiling point.

15. A method for forming an image comprising at least the steps of:

forming a layer including resin particles on a surface of a recording medium;

recording the image by jetting ink from an inkjet recording head onto the resin particle layer so that the ink is retained in cavities of the resin particle layer; and fixing the resin particle layer retaining the ink.

16. The method of claim 15, wherein the resin particles are chargeable, and the step of forming the resin particle layer includes triboelectrically charging the resin particles to form the resin particle layer on the surface of the recording medium by electric field transfer.

17. The method of claim 16, wherein the step of forming the resin particle layer includes:

charging a surface of a photosensitive body;

exposing the surface of the photosensitive body;

adhering the triboelectrically charged resin particles to the exposed region of the surface of the photosensitive body; and transferring the resin particles adhering to the surface of the photosensitive body to the surface of the recording medium by the electric field.

18. The method of claim 17, wherein exposure of the surface of the photosensitive body is conducted on the basis of image signals so that the exposed region corresponds to an image part or periphery thereof.

19. The method of claim 15, wherein at least one of inorganic fine particles and organic fine particles are added to the resin particles by at least one of internal addition and external addition.

20. The method of claim 15, wherein the resin particle layer is preheated between the step of forming the resin particle layer and the step of recording.

21. The method of claim 15, wherein the resin particles include a foaming agent.

22. The method of claim 21, wherein the foaming agent comprises microcapsule particles including a substance having a low boiling point.

23. An apparatus for forming an image comprising at least:

an intermediate transfer medium;

means for forming a layer including resin particles on a surface of the intermediate transfer medium;

means for recording the image by jetting ink from an inkjet recording head onto the resin particle layer so that the ink is retained in cavities of the resin particle layer; and means for transferring the resin particle layer to a recording medium to fix the resin particle layer thereto.

24. The apparatus of claim 23, wherein the intermediate transfer medium includes at least a base layer and a releasing layer and is in the form of an endless belt.

25. The apparatus of claim 23, wherein the transferring and fixing means superposes the intermediate transfer medium on the recording medium, with the resin particle layer on the surface of the intermediate transfer medium disposed therebetween, and heats and applies pressure to the resin particle layer to simultaneously transfer and fix the resin particle layer to the recording medium.

26. The apparatus of claim 25, further comprising means for heating the resin particle layer, the heating means being disposed downstream from the recording means and upstream from the transferring and fixing means.

27. The apparatus of claim 26, wherein the intermediate transfer medium includes a heat-generating layer, and the heating means heats the resin particle layer on the surface of the intermediate transfer medium by heating the heat-generating layer by electromagnetic induction.

28. The apparatus of claim 25, wherein the transferring and fixing means includes:

means for applying heat and pressure to the resin particle layer;

means for cooling the resin particle layer between the intermediate transfer medium and the recording medium after heat and pressure have been applied to the resin particle layer; and means for stripping the recording medium from the intermediate transfer medium after the resin particle layer has been cooled.

29. The apparatus of claim 23, wherein the means for forming the resin particle layer transfers the resin particle layer to the surface of the intermediate transfer medium by electric field transfer of the resin particles that are triboelectrically charged.

30. The apparatus of claim 29, wherein the means for forming the resin particle layer includes:

a photosensitive body;

means for charging a surface of the photosensitive body;

means for exposing the surface of the photosensitive body;

means for adhering the triboelectrically charged resin particles to the exposed region of the surface of the photosensitive body; and means for transferring the resin particles adhering to the surface of the photosensitive body to the surface of the intermediate transfer medium by electric field transfer.

31. The apparatus of claim 30, further including means for controlling exposure such that the exposure of the surface of the photosensitive body is conducted on the basis of image signals so that the exposed region corresponds to an image part or periphery thereof.

32. The apparatus of claim 23, further including means for preheating the resin particle layer, the preheating means being disposed downstream from the means for forming the resin particle layer and upstream from the recording means.

33. The apparatus of claim 32, wherein the intermediate transfer medium includes a heat-generating layer, and the preheating means heats the resin particle layer on the surface of the intermediate transfer medium by heating the heat-generating layer by electromagnetic induction.

34. An apparatus for forming an image comprising at least:

means for forming a layer including resin particles on a surface of a recording medium;

means for recording the image by jetting ink from an inkjet recording head onto the resin particle layer so that the ink is retained in cavities of the resin particle layer; and means for fixing the resin particle layer retaining the ink.

35. The apparatus of claim 34, wherein the means for forming the resin particle layer transfers the resin particle layer to the surface of the intermediate transfer medium by electric field transfer of the resin particles that are triboelectrically charged.

36. The apparatus of claim 35, wherein the means for forming the resin particle layer includes:

a photosensitive body;

means for charging a surface of the photosensitive body;

means for exposing the surface of the photosensitive body;

means for adhering the triboelectrically charged resin particles to the exposed region of the surface of the photosensitive body; and means for transferring the resin particles adhering to the surface of the photosensitive body to the surface of the recording medium by electric field transfer.

37. The apparatus of claim 36, further including means for controlling exposure such that the exposure of the surface of the photosensitive body is conducted on the basis of image signals so that the exposed region corresponds to an image part or periphery thereof.

38. The apparatus of claim 34, further including means for preheating the resin particle layer, the preheating means being disposed downstream from the means for forming the resin particle layer and upstream from the recording means.

* * * * *